US008452215B2

(12) United States Patent
Mihara et al.

(10) Patent No.: US 8,452,215 B2
(45) Date of Patent: May 28, 2013

(54) DEVELOPING DEVICE AND IMAGE FORMING APPARATUS

(75) Inventors: Koichi Mihara, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 349 days.

(21) Appl. No.: 13/010,994

(22) Filed: Jan. 21, 2011

(65) Prior Publication Data

US 2011/0188894 A1 Aug. 4, 2011

(30) Foreign Application Priority Data

Feb. 3, 2010 (JP) ..... 2010-022611

(51) Int. Cl.
*G03G 15/08* (2006.01)

(52) U.S. Cl.
USPC ..... 399/254; 399/256; 399/263

(58) Field of Classification Search
USPC ..... 399/119, 120, 252–263
See application file for complete search history.

(56) References Cited

U.S. PATENT DOCUMENTS

| | | | | |
|---|---|---|---|---|
| 7,251,440 | B2 * | 7/2007 | Shigeta et al. | 399/254 |
| 7,577,383 | B2 * | 8/2009 | Brown et al. | 399/256 |
| 7,792,467 | B2 * | 9/2010 | Stelter et al. | 399/256 |

FOREIGN PATENT DOCUMENTS

| | | | |
|---|---|---|---|
| JP | 10-067029 | A | 3/1998 |
| JP | 2005-024592 | A | 1/2005 |
| JP | 2007-101928 | A | 4/2007 |

* cited by examiner

*Primary Examiner* — Hoan Tran
(74) *Attorney, Agent, or Firm* — Renner, Otto, Boisselle & Sklar, LLP

(57) ABSTRACT

A developing device and an image forming apparatus which suppress unevenness of image density are provided. A developing device includes a developer tank storing a developer, a first conveying member and a second conveying member conveying the developer, and a developing roller bearing the developer thereon. In the developing device, the first conveying member is constituted by a first rotating shaft and a plurality of first conveying blades provided along a first imaginary spiral surrounding the outer periphery of the first rotating shaft and advancing in the axial direction of the first rotating shaft at a predetermined lead angle $\theta_X$. The individual first conveying blades are separated from each other in the axial direction and are provided along the portion of less than one cycle of the first imaginary spiral.

8 Claims, 14 Drawing Sheets

DEVELOPING DEVICE AND IMAGE FORMING APPARATUS

CROSS-REFERENCE TO RELATED APPLICATION

This application claims priority to Japanese Patent Application No. 2010-022611, which was filed on Feb. 3, 2010, the contents of which are incorporated herein by reference in its entirety.

BACKGROUND OF THE INVENTION

1. Field of the Invention

The present invention relates to a developing device and an image forming apparatus.

2. Description of the Related Art

Conventionally, copying machines, printers, facsimiles, or the like are known as an electrophotographic image forming apparatus. These image forming apparatuses form an electrostatic latent image on the surface of a photoreceptor drum (toner image bearing member), supply a toner to the photoreceptor drum using a developing device to develop this electrostatic latent image, transfer a toner image on the photoreceptor drum to a recording medium such as a recording paper, using a transfer part, and fix the toner image onto the recording paper using a fixing device, thereby forming an image.

As a conventional developing device, there is a circulation-type developing device like a developing device disclosed in Japanese Unexamined Patent Publication JP-A 2005-24592, including two developer conveying passages through which a toner is circulated and conveyed, and two conveying members which convey the toner in the developer conveying passages. In such a conventional developing device, the toner is charged by the conveying members, the charged toner is borne on the surface of a developing roller provided in the developing device, and the toner is supplied to an electrostatic latent image from the developing roller by an electrostatic attraction force. The conventional developing device'forms the toner image on the photoreceptor drum in this way.

However, in the above developing device, the conveying member is constituted by a rotating shaft, and a spiral blade which is a stretch of conveying blade. Thus, the toner is blocked by the spiral blade and is not easily diffused in an axial direction of the rotating shaft. Therefore, when a toner is consumed locally or a new toner is supplied, there is a problem in that unevenness occurs in the concentration of the toner in the developer conveying passages. As a result, there is a problem in that unevenness of image density occurs in a formed image.

SUMMARY OF THE INVENTION

The invention has been made in view of the above-described problems, and an object thereof is to provide a developing device and an image forming apparatus which suppress unevenness of image density.

The invention provides a developing device comprising:

a developer tank for storing a developer;

a conveying member for conveying the developer, the conveying member including a rotating shaft and a plurality of conveying blades for conveying the developer in an axial direction of the rotating shaft which are provided along a first imaginary spiral surrounding an outer periphery of the rotating shaft and advancing in the axial direction at a predetermined lead angle; and a developing roller for bearing the developer thereon, the individual conveying blades being provided along a portion of less than one cycle of the first imaginary spiral so as to be separated from each other in the axial direction.

According to the invention, the individual conveying blades are provided so as to be separated from each other in the axial direction of the rotating shaft. Thus, a gap is formed between the conveying blades, and a toner is easily diffused in the axial direction of the rotating shaft through the gap. Accordingly, even if the toner in the developer tank is consumed locally or an unused toner is supplied, the toner is diffused rapidly and unevenness of toner concentration in a developer hardly occurs. Thus, unevenness of image density can be suppressed. Additionally, even if one conveying blade of the plurality of conveying blades is damaged, only the damaged conveying blade can be replaced. Thus, the conveying member can be easily repaired.

Additionally, in the invention, it is preferable that intervals between conveying blades adjacent to each other in the axial direction in the conveying blades are all equal.

According to the invention, since the conveying blades are provided at equal intervals, the load applied to a developer during conveyance of the developer can be distributed.

Additionally, in the invention, it is preferable that the conveying blades are provided so as to run along a second imaginary spiral which satisfies the following expression (1) when an outer peripheral portion which is a portion most separated from the rotating shaft in each of the conveying blade is a second imaginary spiral surrounding an imaginary cylinder in which the rotating shaft and the axis coincide with each other and advancing in the axial direction at a predetermined lead angle:

$$0[°]<\theta_Y[°]<\tan^{-1}(r\cdot\tan\theta_X/R)[°]<90[°] \quad (1)$$

in which $\theta_X$ is a lead angle of the first imaginary spiral, $\theta_Y$ is a lead angle of the second imaginary spiral, r is a radius of the rotating shaft, and R (>r) is a radius of the imaginary cylinder.

According to the invention, the conveying member is configured so that the lead angle $\theta_Y$ of the second imaginary spiral satisfies the above expression (1). Thereby, the conveying speed of a developer becomes faster on the side of the inner peripheral portion of the conveying member, and becomes slower on the side of the outer peripheral portion. Accordingly, since the aggregation caused by friction or pressure is kept from occurring in the toner in the gap between the conveying member and the internal wall of the developer tank, image fogging can be suppressed.

Additionally, in the invention, it is preferable that the conveying blades are multi-stage spiral blade pieces.

According to the invention, by providing multi-stage spiral blade pieces as the conveying blades, it is possible to provide a configuration in which the conveying speed of a developer becomes faster on the side of the inner peripheral portion of the conveying member, and becomes slower on the side of the outer peripheral portion.

Additionally, in the invention, it is preferable that the conveying blades are twisted blades.

According to the invention, by providing twisted blades as the conveying blades, it is possible to provide a configuration in which the conveying speed of a developer becomes faster on the side of the inner peripheral portion of the conveying member, and becomes slower on the side of the outer peripheral portion.

Additionally, in the invention, it is preferable that the conveying member is configured so that the lead angle $\theta_Y$ of the second imaginary spiral satisfies the following expression (2):

$$0[°]<\tan^{-1}(0.3\cdot r\cdot\tan\theta_X/R)[°]<\theta_Y[°]<\tan^{-1}(0.7\cdot r\cdot\tan\theta_X/R)/2[°]<90[°] \quad (2).$$

According to the invention, the conveying member is configured so that the lead angle $\theta_Y$ of the second imaginary spiral satisfies the above expression (2). Thereby, the speed ratio between the conveying speed of a developer at the outer peripheral portion of the conveying member and the conveying speed of the developer at the inner peripheral portion can be set to a favorable speed ratio, and friction against the toner can be further suppressed.

Additionally, in the invention, it is preferable that the conveying blades are respectively provided along the portion of a 1/12 cycle or more and a 1/4 cycle or less of the first imaginary spiral.

According to the invention, the conveying blades are respectively provided along the portion of a 1/12 cycle or more and a 1/4 cycle or less of the first imaginary spiral. Thus, the conveyance property of a developer and the diffusivity of the toner can be made compatible with each other.

Additionally, the invention provides an electrophotographic image forming apparatus comprising the developing device mentioned above.

According to the invention, an electrophotographic image forming apparatus comprises the developing device mentioned above, so that the image forming apparatus can form an image with unevenness of image density suppressed.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
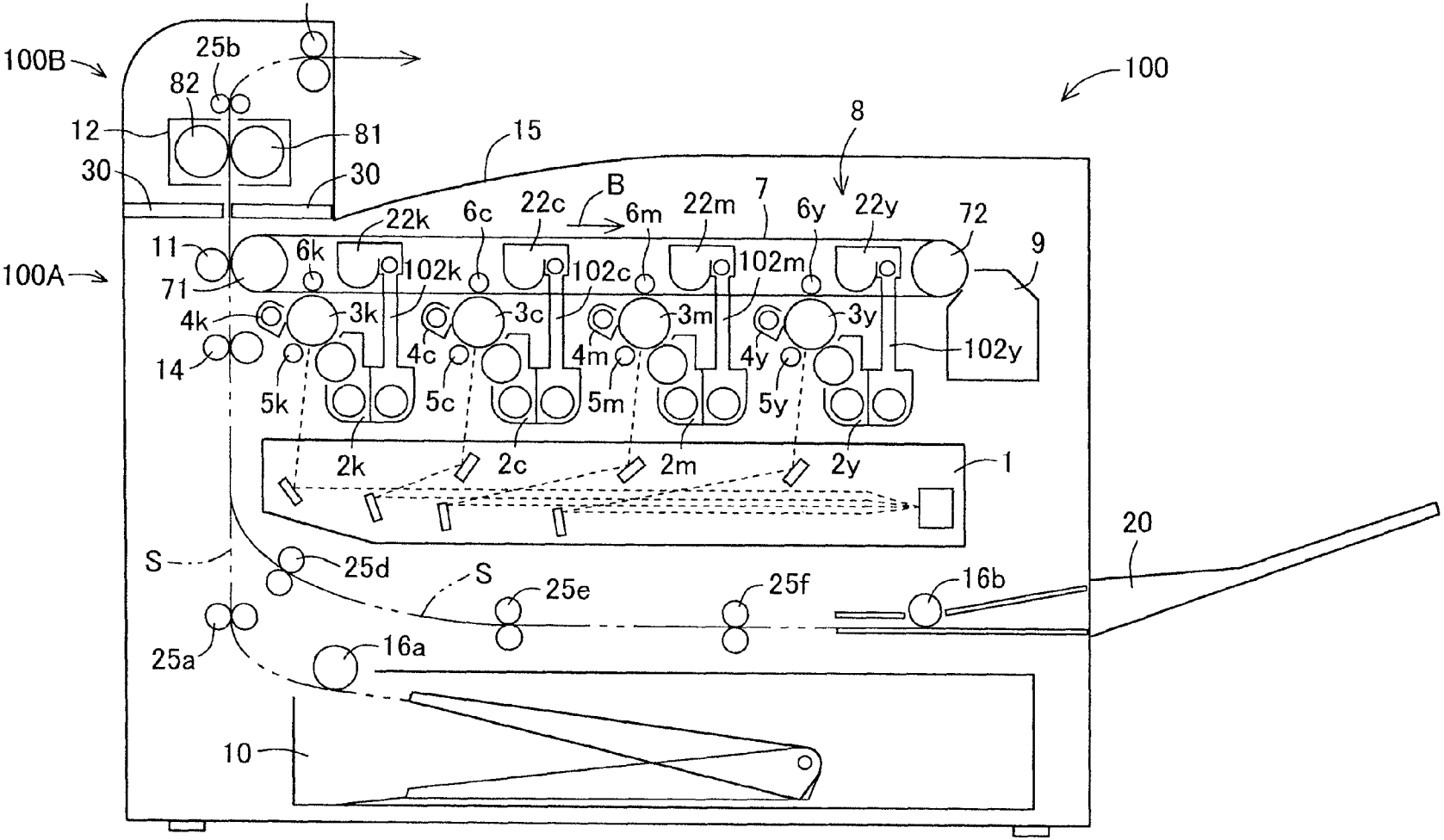
FIG. 1 is a schematic view showing the configuration of an image forming apparatus.

Now referring to the drawings, preferred embodiments of the invention are described below.

A developing device 2 which is an embodiment of the developing device related to the invention, and an image forming apparatus 100 which is an embodiment of the image forming apparatus related to the invention will be described below. FIG. 1 is a schematic view showing the configuration of the image forming apparatus 100.

The image forming apparatus 100 is an apparatus which forms a multicolor or monochrome image in a predetermined recording medium (recording paper or the like) according to the image data transmitted from the outside. In addition, the image forming apparatus 100 may be configured so that an image reading part such as a scanner, is provided at a vertical upper portion of the image forming apparatus 100, and an image is formed on the basis of the image data obtained by the image reading part.

The image forming apparatus 100 includes a toner image forming part 100A in which the developing device 2 is received, and a fixing part 100B in which a fixing device 12 is received. A partition wall 30 which insulates heat generated by the fixing device 12 so that the heat is not transmitted to the toner image forming part 100A is provided between the toner image forming part 100A and the fixing part 100B. Additionally, the image forming apparatus 100 includes a sheet feed tray 10, a manual feed tray 20, a sheet conveying path S, and a catch tray 15.

The toner image forming part 100A receives photoreceptor drums 3 (3*c*, 3*m*, 3*y*, 3*k*), charging devices 5 (5*c*, 5*m* 5*y*, 5*k*), an exposure unit 1, developing devices 2 (2*c*, 2*m*, 2*y*, 2*k*), toner replenishing devices 22 (22*c*, 22*m*, 22*y*, 22*k*), toner conveying pipes 102 (102*c*, 102*m*, 102*y*, 102*k*), cleaner units 4 (4*c*, 4*m*, 4*y*, 4*k*), an intermediate transfer belt unit 8, and a transfer roller 11. In addition, as for the individual signs of c, m, y, and k at the ends of the reference signs, c is a sign representing a member for formation of a cyan image, m is a sign representing a member for formation of a magenta image, y is a sign representing a member for formation of a yellow image, and k is a sign representing a member for formation of a black image.

A cyan toner image, a magenta toner image, a yellow toner image, and a black toner image are formed on the surfaces of the individual photoreceptor drums 3 (3*c*, 3*m*, 3*y*, 3*k*), respectively, on the basis of the image data for individual color components of cyan (c), magenta (m), yellow (y), and black (k) which are inputted to the image forming apparatus 100, and the formed individual toner images are overlaid on top of one another on the intermediate transfer belt unit 8, thereby forming a color image.

The photoreceptor drum 3 is a cylindrical member which is supported by a driving part (not shown) so as to be rotatable around an axis thereof. The photoreceptor drum 3 includes a conductive substrate (not shown) and a photosensitive layer formed on the surface of the conductive substrate. The photosensitive layer is a member which exhibits electric conductivity by being irradiated with light. An electric image called an electrostatic latent image is formed on the surface of the photosensitive layer of the photoreceptor drum 3 by charging by the charging device 5 and exposure by the exposure unit 1.

The charging device 5 is a device which uniformly charges the surface of the photoreceptor drum 3 to a predetermined potential. In the present embodiment, a contact-roller type charging device is used as the charging device 5. However a contact-brush type charging device, a non-contact charger type charging device, or the like may be used.

The exposure unit 1 is a device which irradiates the surface of the photoreceptor drum 3 with the light according to image data. The exposure unit 1 exposes the charged photoreceptor drum 3 according to input image data, thereby forming an electrostatic latent image according to the image data on the surface of the photoreceptor drum 3. In the present embodiment, a laser scanning unit (LSU) including a laser irradiation part and a reflective mirror may be used as the exposure unit 1. However, an EL (electroluminescent) or an LED write head in which light emitting elements are arrayed, may be used.

The developing device 2 is a device which causes the electrostatic latent image formed on the photoreceptor drum 3 with a toner to appear, thereby forming a toner image on the photoreceptor drum 3. The toner conveying pipe 102 is connected to a vertical upper portion of the developing device 2. The developing device 2 will be described below in detail.

The toner replenishing device 22 is disposed vertically above the developing device 2, and stores unused toner. The toner conveying pipe 102 is connected to a vertical lower portion of the toner replenishing device 22. The toner replenishing device 22 supplies a toner to the developing device 2 via the toner conveying pipe 102. The toner replenishing device 22 will be described below in detail.

The cleaner unit 4 is a device which removes and collects the toner which remains on the surface of the photoreceptor drum 3 after development and transfer of a toner image.

The intermediate transfer belt unit 8 is arranged vertically above the photoreceptor drum 3. The intermediate transfer belt unit 8 includes an intermediate transfer roller 6 (6*c*, 6*m*, 6*y*, 6*k*), an intermediate transfer belt 7, an intermediate transfer belt driving roller 71, and an intermediate transfer belt driven roller 72, and an intermediate transfer belt cleaning unit 9.

The intermediate transfer belt driving roller 71 and the intermediate transfer belt driven roller 72 are members which support the intermediate transfer belt 7 therearound with tension and rotate the intermediate transfer belt 7 in the direction of an arrow B.

The intermediate transfer belt 7 is provided so as to come into contact with the individual photoreceptor drums 3. By sequentially transferring and overlaying toner images of individual color components formed on the photoreceptor drums 3 on the intermediate transfer belt 7, color toner images (multicolor toner image) are formed on the intermediate transfer belt 7. The intermediate transfer belt 7 is formed in an endless shape using, for example, a film with a thickness of about 100 μm to 150 μm.

The intermediate transfer roller 6 is rotatably supported at a position where the roller faces the photoreceptor drum 3 with the intermediate transfer belt 7 interposed therebetween. The transfer bias for transferring a toner image on the photoreceptor drum 3 to the intermediate transfer belt 7 is applied to the intermediate transfer roller 6. The intermediate transfer roller 6 is formed using, for example, a shaft made of metal (stainless steel or the like) whose diameter is 8 mm to 10 mm as a base, and the surface thereof is covered with a conductive elastic material (ethylene propylene diene rubber (EPDM), urethane foam, or the like). The intermediate transfer roller 6 can uniformly apply a high voltage to the intermediate transfer belt 7 by this conductive elastic material. In the present embodiment, the roller-shaped intermediate transfer roller 6 is used, but a brush-shaped intermediate transfer roller may be used.

The intermediate transfer belt cleaning unit 9 is a member for removing and collecting the toner which remains on the intermediate transfer belt 7 without being transferred to a recording medium from the intermediate transfer belt 7. The intermediate transfer belt cleaning unit 9 includes a cleaning blade which comes into contact with the intermediate transfer belt 7. The cleaning blade is provided at a position where the cleaning blade faces the intermediate transfer belt driven roller 72 with the intermediate transfer belt 7 interposed therebetween.

The transfer roller 11 is provided at a position where the transfer roller faces the intermediate transfer belt driving roller 71, and forms a transfer nip along with the intermediate transfer belt driving roller 71. A predetermined voltage is applied to the transfer roller 11. The toner images stacked on the intermediate transfer belt are transferred to a recording medium conveyed to the transfer nip by this voltage. In order to obtain the transfer nip regularly, any one of the transfer roller 11 and the intermediate transfer belt driving roller 71 is formed of hard materials such as a metal, and the other is formed of soft materials (an elastic rubber roller, a foamable resin roller, or the like) such as an elastic roller.

The sheet feed tray 10 is provided vertically below the exposure unit 1 to accumulate recording mediums (recording paper or the like) to be used for image formation. The manual feed tray 20 is to accumulate recording mediums to be used for image formation.

The catch tray 15 is provided at a vertical upper portion of the image forming apparatus 100 to place a printed recording medium thereon in a face-down manner.

The sheet conveying path S is to guide recording mediums accumulated in the sheet feed tray 10 or the manual feed tray 20 to the catch tray 15 via the transfer nip and the fixing device 12. Pickup rollers 16 (16*a*, 16*b*), registration rollers 14 and conveying rollers 25 (25*a*, 25*b*, 25*c*, 25*d*, 25*e*, 25*f*, 25*g*, 25*h*) are arranged on the sheet conveying path S.

The pickup roller 16*a* is a drawing roller which is provided at an end of the sheet feed tray 10 to supply a recording medium one by one to the sheet conveying path S from the sheet feed tray 10. The pickup roller 16*b* is a drawing roller which is provided near the manual feed tray 20 to supply recording mediums one by one to the sheet conveying path S from the manual feed tray 20.

The conveying rollers 25 are a plurality of small roller pairs which are provided along the sheet conveying path S to convey a recording medium.

The registration rollers 14 are members which hold a conveyed recording medium once and conveys the recording medium to the transfer nip at the timing when the tip of the recording medium and the tips of the stacked toner images on the intermediate transfer belt 7 are matched with each other. The recording medium to which the toner images have been transferred at the transfer nip is conveyed to the fixing device 12.

The fixing device 12 is received in the fixing part 100B. The fixing device 12 includes a heat roller 81 and a pressure roller 82. The heat roller 81 is controlled by a control part (not shown) so as to have a predetermined fixing temperature. The control part controls the temperature of the heat roller 81 on the basis of a detection signal from a temperature detector (not shown). The pressure roller 82 is a roller brought into pressure-contact with the heat roller 81.

The heat roller 81 pinches a recording medium along with the pressure roller 82 while applying heat to the recording medium, thereby melting toner images to fix the toner images on the recording medium. The recording medium on which the toner images have been fixed is discharged to the catch tray 15 in a face-down manner by the conveying rollers 25*c*.

Figure 2:
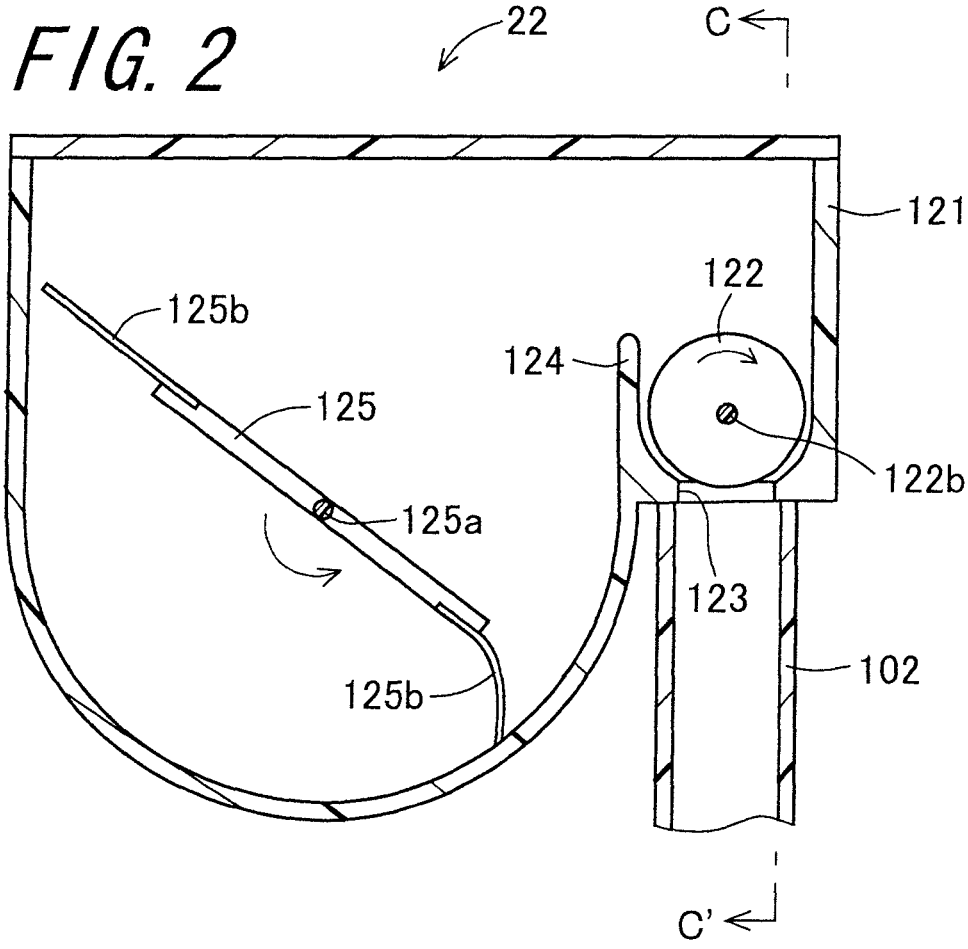
FIG. 2 is a schematic view showing the configuration of a toner supply device.
Figure 3:
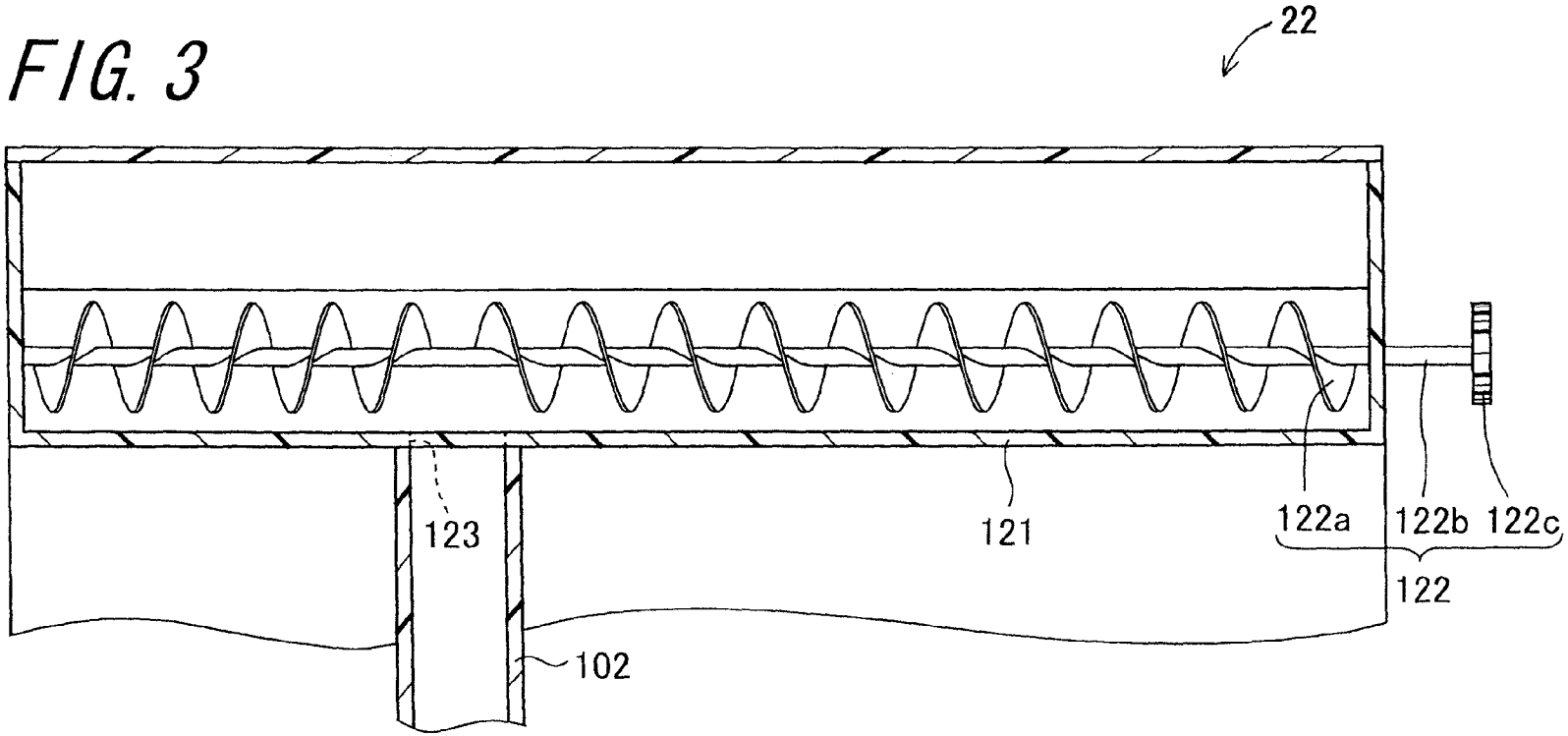
FIG. 3 is a sectional view of the toner supply device taken along the line C-C' of FIG. 2.

FIG. 2 is a schematic view showing the configuration of the toner replenishing device 22, and FIG. 3 is a sectional view of the toner replenishing device 22 taken along the line C-C' of FIG. 2. The toner replenishing device 22 includes a toner storage container 121, a toner stirring member 125, a toner discharge member 122, and a toner discharge port 123. The toner replenishing device 22 rotates the toner discharge member 122, thereby supplying a toner to the developing device 2 via the toner conveying pipe 102 from the toner discharge port 123.

The toner storage container 121 is a substantially semi-cylindrical container having an internal space, rotatably supports the toner stirring member 125 and the toner discharge member 122, and stores a toner. The toner discharge port 123 is a substantially rectangular opening which is provided near an axial central portion at a vertical lower portion of the toner discharge member 122, and is arranged at a position where the toner discharge port faces the toner conveying pipe 102.

The toner stirring member 125 includes a rotating base 125*a* and a toner scooping member 125*b* provided at the rotating base 125*a*. As the rotating base 125*a* rotates about an axis thereof, the toner scooping member 125*b* conveys and scoops the toner within the toner storage container 121 to the toner discharge member 122 while stirring the toner stored in the toner storage container 121. The toner scooping member 125*b* is made of a polyethylene terephthalate (PET) sheet having flexibility and is attached to both ends of the rotating base 125*a*.

The toner discharge member 122 is a member which supplies the toner within the toner storage container 121 to the developing device 2 from the toner discharge port 123. The toner discharge member 122 is constituted by an auger screw including a toner discharge blade 122*a* and a toner-discharge-member rotating shaft 122*b*, and a toner-discharge-member rotating gear 122*c*. The toner discharge member 122 is rotated by a toner-discharge-member driving motor (not shown). A toner is conveyed toward the toner discharge port 123 from both axial ends of the toner discharge member 122 by the auger screw.

A toner-discharge-member partition wall 124 is provided between the toner discharge member 122 and the toner stirring member 125. An appropriate amount of toner can be held around the toner discharge member 122 by the toner-discharge-member partition wall 124.

Figure 4:
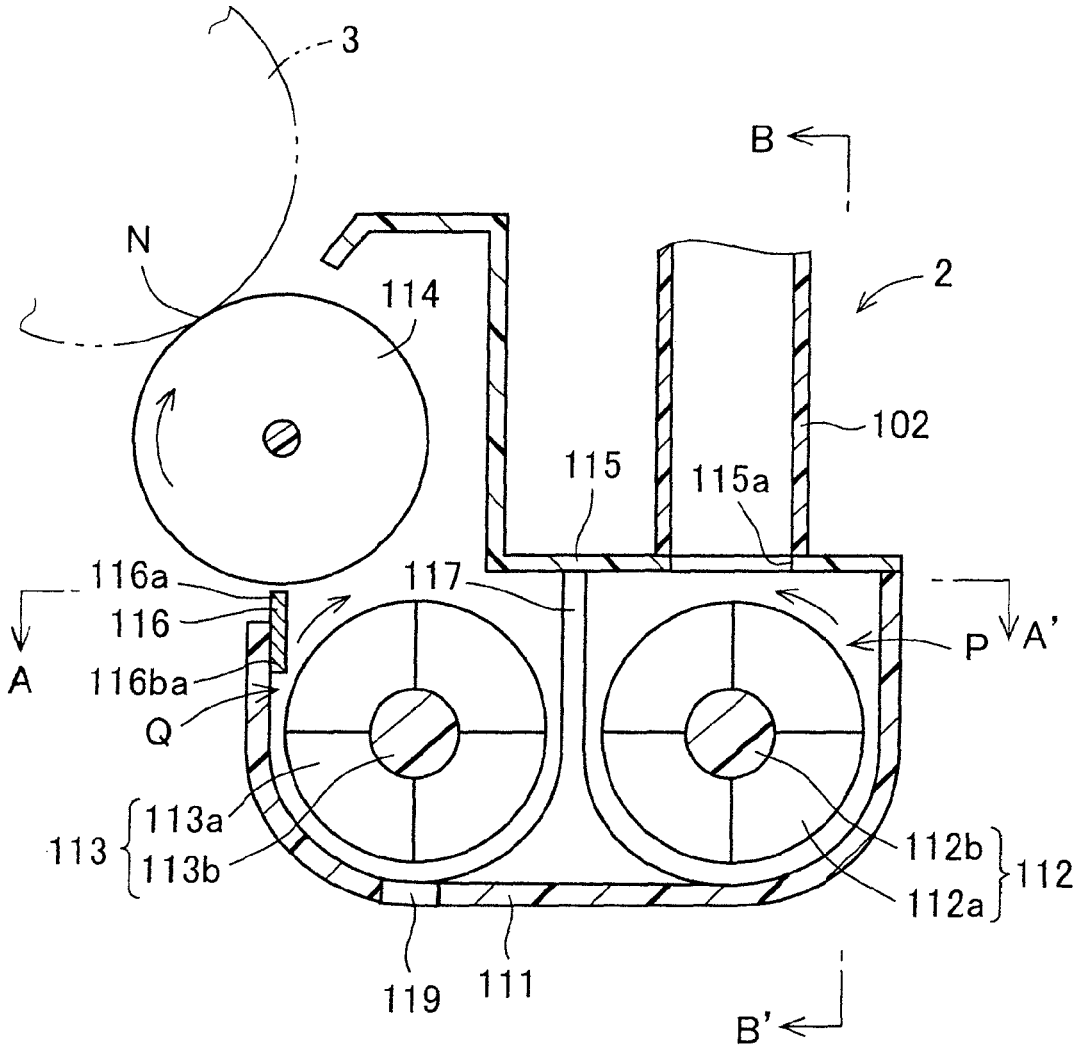
FIG. 4 is a schematic view showing the configuration of a developing device.
Figure 5:
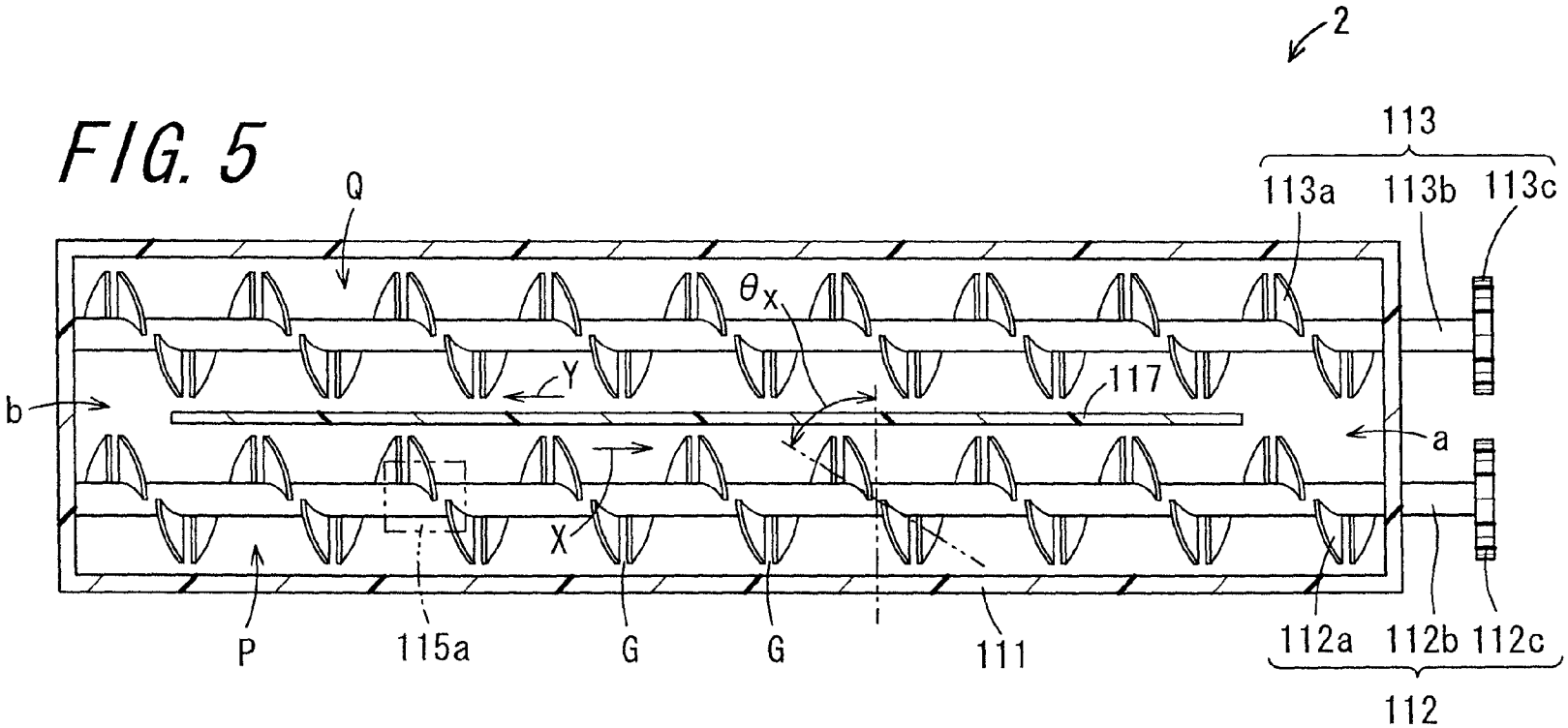
FIG. 5 is a sectional view of the developing device taken along the line A-A' of FIG. 4.
Figure 6:
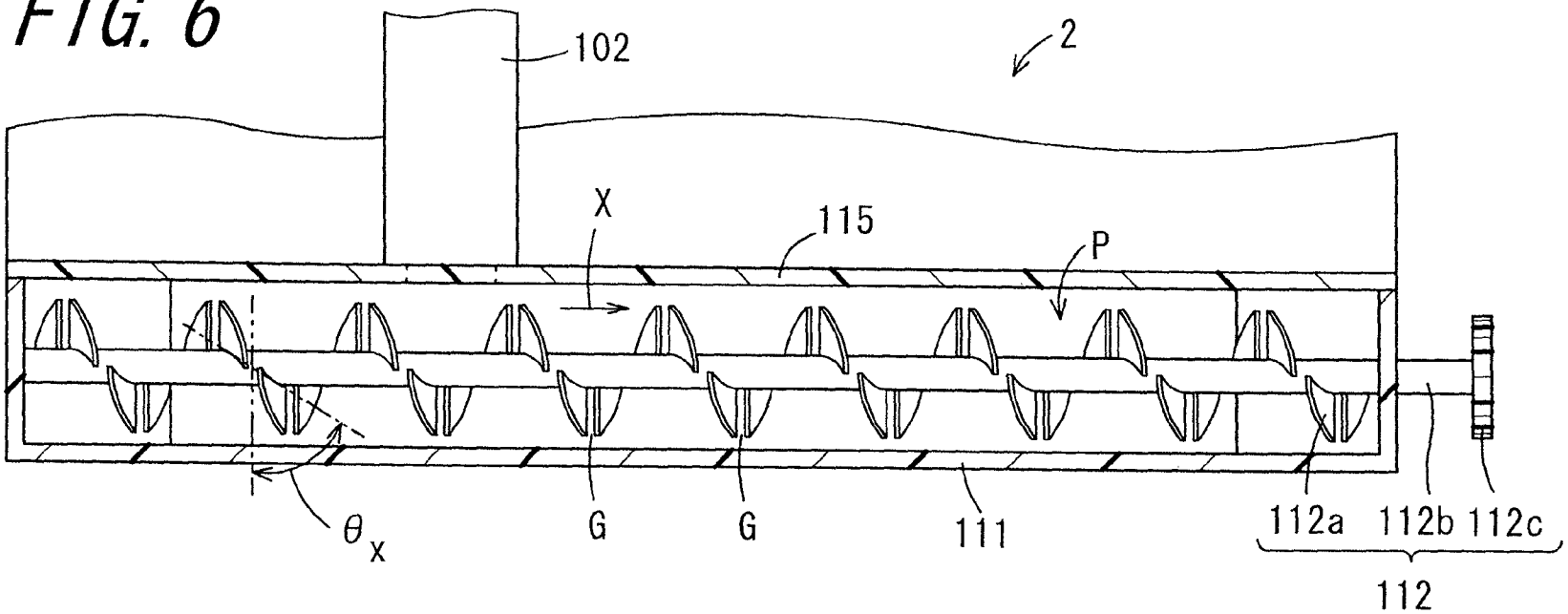
FIG. 6 is a sectional view of the developing device taken along the line B-B' of FIG. 4.

FIG. 4 is a schematic view showing the configuration of the developing device 2. FIG. 5 is a sectional view of the developing device 2 taken along the line A-A' of FIG. 4. FIG. 6 is a sectional view of the developing device 2 taken along the line B-B' of FIG. 4. The developing device 2 includes a developer tank 111, a first conveying member 112, a second conveying member 113, a developing roller 114, a developer tank cover 115, a toner replenishing port 115*a*, a doctor blade 116, a partition plate 117, and a toner concentration detecting sensor 119. The developing device 2 is a device which supplies the toner within the developer tank 111 to the surface of the photoreceptor drum 3 by the developing roller 114, thereby visualizing an electrostatic latent image formed on the surface of the photoreceptor drum 3.

The developer tank 111 is a container-like member which contains a developer. A one-component developer which consists only of a toner or a two-component developer including a toner and a carrier may be used as the developer. The developer tank 111 is provided with the first conveying member 112, the second conveying member 113, the developing roller 114, the developer tank cover 115, the doctor blade 116, and the partition plate 117, and the toner concentration detecting sensor 119.

The developing roller 114 is a magnet roller which is rotated around an axis thereof by a driving part (not shown), and attracts the developer within the developer tank 111 to bear the developer on the surface thereof, and supplies the toner contained in the developer borne on the surface to the photoreceptor drum 3. The developing roller 114 is provided at a position where the developing roller faces the photoreceptor drum 3. A power source (not shown) is connected to the developing roller 114, and a development bias voltage is applied to the developing roller. The toner borne on the developing roller 114 is moved to the photoreceptor drum 3 by the development bias voltage in a portion closest to the photoreceptor drum 3 (development nip region N).

The doctor blade 116 is provided at a position close to the surface of the developing roller 114 to regulate the amount of the developer borne on the developing roller 114. The doctor blade 116 is a rectangular plate-shaped member which extends parallel to the direction of an axis of the developing roller 114, and has one end 116*b* in the width direction supported by the developer tank cover 115 and the other end 116*a* provided on the surface of the developing roller 114 with a gap therebetween. As the material of the doctor blade 116, stainless steel, aluminum, synthetic resin, or the like can be used.

The toner concentration detecting sensor 119 is mounted at a substantially central portion in a developer conveying direction vertically below the second conveying member 113 at the bottom face of the developer tank 111, and is provided so that the surface of the sensor is exposed to the internal space of the developer tank 111. The toner concentration detecting sensor 119 is electrically connected to a toner concentration control part (not shown).

The toner concentration control part performs control so as to rotate the toner discharge member 122 according to a toner concentration measurement value that is detected by the toner concentration detecting sensor 119, and to supply a toner to the inside of the developer tank 111 via the toner discharge port 123. When it is determined that the toner concentration measurement value by the toner concentration detecting sensor 119 is lower than a toner concentration setting value, the toner concentration control part sends a control signal to a driving part which rotates the toner discharge member 122, and rotates the toner discharge member 122.

A general toner concentration detecting sensor can be used as the toner concentration detecting sensor 119. Examples of the toner concentration detecting sensor 119 include a transmitted light detecting sensor, a reflected light detecting sensor, and a magnetic permeability detecting sensor. Among these sensors, the magnetic permeability detecting sensor is preferable.

In the present embodiment, the magnetic permeability detecting sensor is used as the toner concentration detecting sensor 119. A power source (not shown) is connected to the toner concentration detecting sensor 119 (magnetic permeability detecting sensor). The power source applies a driving voltage for driving the toner concentration detecting sensor 119 and a control voltage for outputting a detection result of toner concentration to the toner concentration control part to the toner concentration detecting sensor 119. The application of a voltage to the toner concentration detecting sensor 119 by the power source is controlled by a control part (not shown). The toner concentration detecting sensor 119 is a sensor of a type which receives the application of a control voltage to output the detection result of toner concentration as an output voltage value. Since the sensor basically has a good sensitivity near a median value of an output voltage, the sensor is used to apply a control voltage such that an output voltage near the median value is obtained. This type of magnetic permeability detecting sensor is commercially available, and examples thereof include TS-L (trade name; made by TDK Corp.), TS-A (trade name; made by TDK Corp.), and TS-K (trade name; made by TDK Corp).

The developer tank cover 115 is removably provided on the vertical upside of the developer tank 111. The developer tank cover 115 is formed with the toner replenishing port 115*a* for supplying an unused toner into the developer tank 111. The toner stored in the toner replenishing device 22 is replenished into the developer tank 111 via the toner conveying pipe 102 and the toner replenishing port 115*a*.

The developer tank 111 is provided with the second conveying member 113, the first conveying member 112, and the partition plate 117 arranged between the first conveying member 112 and the second conveying member 113.

The first conveying member 112 and the second conveying member 113 are provided side by side with the partition plate 117 interposed therebetween so that the axes thereof become parallel to each other. The first conveying member 112 conveys a developer in the direction of an arrow X which is one direction in the longitudinal direction of the developer tank 111, and the second conveying member 113 conveys the developer in the direction of an arrow Y which is a direction opposite to the direction of the arrow X.

The first conveying member 112 includes a plurality of first conveying blades 112*a*, a first rotating shaft 112*b*, and a first conveying gear 112*c*. The first conveying member 112 conveys a developer in the direction of the arrow X due to rotation by means of a driving part such as a motor. The first conveying member 112 will be described below in detail.

The second conveying member 113 includes a plurality of second conveying blades 113*a*, a second rotating shaft 113*b*, and a second conveying gear 113*c*, and is configured similarly to the first conveying member 112. The second conveying member 113 conveys a developer in the direction of the arrow Y due to rotation by means of a driving part such as a motor. In addition, the second conveying member 113 may be configured similarly to the first conveying member 120 which will be described later, and may be configured similarly to the first conveying member 130. Additionally, in the present embodiment, the second conveying member 113 is configured similarly to the first conveying member 112. In another embodiment, however, any one of the first conveying member 112 and the second conveying member 113 may be an auger screw like the toner discharge member 122.

The partition plate 117 extends parallel to the axial direction of the first conveying member 112 and the second conveying member 113. The internal space of the developer tank 111 is partitioned into a first conveying passage P where the first conveying member 112 is arranged and a second conveying passage Q where the second conveying member 113 is arranged by the partition plate 117.

The partition plate 117 is arranged so that their both ends in the axial direction of the first conveying member 112 and the second conveying member 113 are separated from the inner wall surface of the developer tank 111. Accordingly, the first conveying passage P and the second conveying passage Q communicate with each other near both ends of the first conveying member 112 and the second conveying member 113 in the axial direction. A communication passage which communicates with the first conveying passage P and the second conveying passage Q on the downstream in the developer conveying direction (the direction of the arrow X) of the first conveying member 112, is referred to as a first communication passage a. A communication passage which communicates with the first conveying passage P and the second conveying passage Q on the downstream in the developer conveying direction (the direction of the arrow Y) of the second conveying member 113, is referred to as a second communication passage b.

The toner replenishing port 115*a* is formed near the second communication passage b in an area within the first conveying passage P. Accordingly, a toner is supplied to the upstream side in the developer conveying direction (the direction of the arrow X) in the first conveying passage P.

A developer circulates and moves through the first conveying passage P, the first communication passage a, the second conveying passage Q, and the second communication passage b in the developer tank 111 in this order: the first conveying passage P→the first communication passage a→the second conveying passage Q→the second communication passage b. Also, in the second conveying passage Q, the developer is attracted to and borne on the surface of the developing roller 114 by the developing roller 114, and the toner in the attracted developer is moved to the photoreceptor drum 3, and consumed sequentially. When the toner is consumed, an unused toner is replenished to the first conveying passage P from the toner replenishing port 115*a*. The replenished toner is diffused in the developer which was present from before replenishment, in the first conveying passage P.

The first conveying member 112 will be described below in detail. The first conveying member 112 includes the first conveying blades 112*a*, the first rotating shaft 112*b*, and the first conveying gear 112*c*, as described above. The first conveying blades 112*a*, the first rotating shaft 112*b*, and the first conveying gear 112*c* are formed of, for example, materials such as polyethylene, polypropylene, high impact polystyrene, or an ABS resin (acrylonitrile-butadiene-styrene copolymerized synthetic resin). The first rotating shaft 112*b* is a cylindrical member, and the radius r of the cylinder is appropriately set within a range of 2 mm to 10 mm. The first rotating shaft 112*b* rotates at 200 rpm to 500 rpm due to a driving part (not shown) and the first conveying gear 112*c*.

The first conveying blades 112*a* rotates with the rotation of the first rotating shaft 112*b*, thereby conveying the developer of the first conveying passage P in the direction of the arrow X. The first conveying blades 112*a* are provided along a first imaginary spiral (not shown) which surrounds the outer periphery of the first rotating shaft 112*b* and advances in the axial direction of the first rotating shaft 112*b* at a predetermined lead angle $\theta_X$. The "lead angle" in the spiral is an angle formed by a tangential line at an arbitrary point on this spiral, and a straight line obtained when projecting this tangential line to a plane perpendicular to the axial direction of an imaginary cylinder surrounded by this spiral. The lead angle is an angle which is greater than 0° and smaller than 90°. The lead angle $\theta_X$ can be appropriately set within a range of, for example, 20° to 70°.

The first imaginary spiral may be a stretch of a spiral and may be a multi-spiral. The individual first conveying blades 112*a* are provided along a portion of less than one cycle of the first imaginary spiral. In the present embodiment, the individual first conveying blades 112*a* are formed of spiral blade pieces all having the same shape, and are provided along the portion of a ¼ cycle of the first imaginary spiral.

In the invention, the "spiral blade pieces" are members roughly having a shape which divides a blade portion of the auger screw by a plane including the axis of the auger screw, and more specifically, are members each having a spiral blade plane as a main plane. In the invention, the "spiral blade plane" is a plane formed by the locus of one segment $L_1$ when the segment $L_1$ has been moved in one direction A parallel to the axis of an imaginary cylinder $K_1$ with the length $m_1$ of the segment $L_1$ in the radial direction of the imaginary cylinder $K_1$ and an attachment angle $\alpha$ being maintained, along the portion of less than one cycle of one spiral $C_1$ (whose lead angle is defined as $\theta_1$) surrounding the lateral surface of the imaginary cylinder $K_1$ (whose radius is defined as $r_1$). The "attachment angle $\alpha$" is an angle formed by the segment $L_1$ and a half-line extending in one direction A from the point of contact between the segment $L_1$ and the imaginary cylinder $K_1$, in a plane including the axis of the imaginary cylinder $K_1$ and the segment $L_1$, and is an angle which is greater than 0° and smaller than 180°.

Figure 7B:
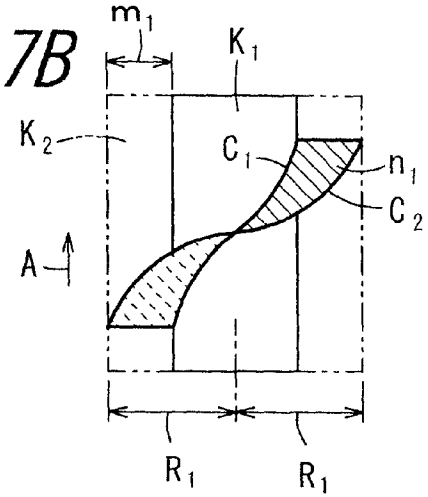
FIGS. 7A to 7C are views for explaining a spiral blade plane of a ½ cycle.
Figure 7A:
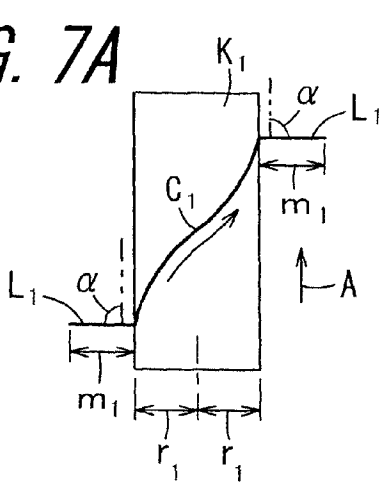
Figure 7C:
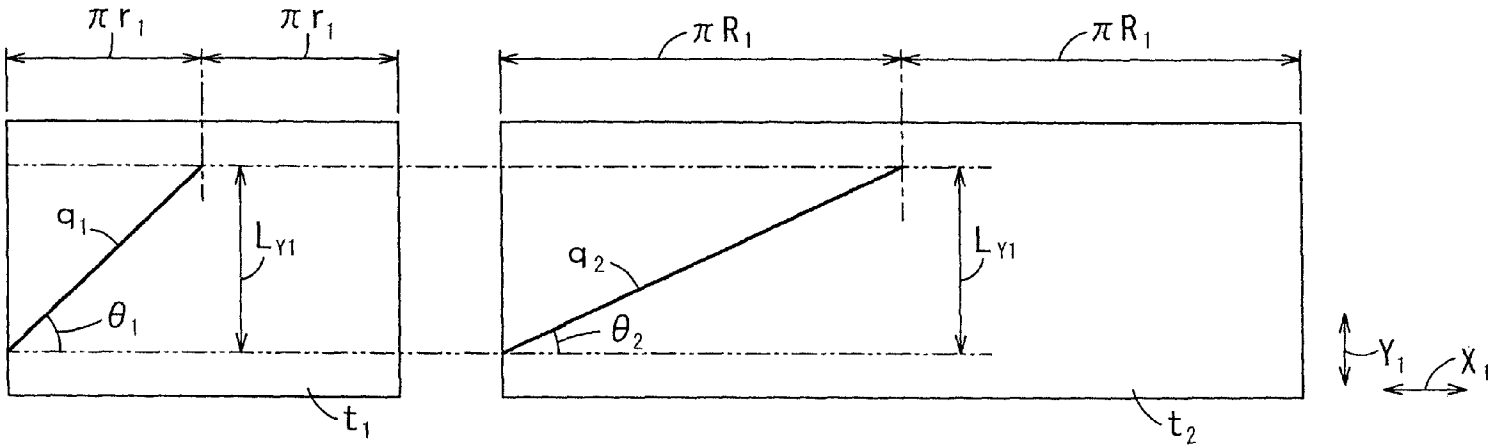

A spiral blade plane when a segment has been moved along the portion of a ½ cycle of a spiral (expressed as a "spiral blade plane of a ½ cycle"; the same is true on other cycles) is shown below as an example of the spiral blade plane. FIGS. 7A to 7C are views for explaining the spiral blade plane of a ½ cycle. FIG. 7A shows the lateral surface of an imaginary cylinder $K_1$, a spiral $C_1$ on the lateral surface of the imaginary cylinder $K_1$, and the start position and end position of the segment $L_1$ that moves on the spiral $C_1$ in one direction A. On the sheet surface of FIG. 7A, the segment $L_1$ shown on the left represents a start position during movement, and the segment $L_1$ shown on the right represents an end position. As shown in FIG. 7A, when the segment $L_1$ is moved in one direction A along the spiral $C_1$ while the length $m_1$ of the segment $L_1$ in the radial direction of the imaginary cylinder $K_1$ and an attachment angle $\alpha$ ($\alpha$=90° in FIGS. 7A to 7C) are kept constant, the locus of the segment $L_1$ becomes a spiral blade plane $n_1$ shown in FIG. 7B. The plane shown by a hatched portion in FIG. 7B is the spiral blade plane $n_1$.

As shown in FIG. 7B, an outer peripheral portion of the spiral blade plane $n_1$ runs along a spiral $C_2$ (whose lead angle is defined as $\theta_2$) which surrounds an imaginary cylinder $K_2$ whose axis coincides with that of the imaginary cylinder $K_1$. The radius $R_1$ of the imaginary cylinder $K_2$ is equal to the sum of the radius $r_1$ of the imaginary cylinder $K_1$, and the length $m_1$ of the segment $L_1$ in the radial direction of the imaginary cylinder $K_1$. A rectangle $t_1$ when the lateral surface of the imaginary cylinder $K_1$ is developed and a rectangle $t_2$ when the lateral surface of the imaginary cylinder $K_2$ is developed are shown in FIG. 7C. As shown in FIG. 7C, the lines corresponding to the spirals $C_1$ and $C_2$ in the rectangles $t_1$ and $t_2$ become segments $q_1$ and $q_2$ extending obliquely in the rectangles $t_1$ and $t_2$. Since these two segments $q_1$ and $q_2$ correspond to the spiral $C_1$ running along an inner peripheral portion of the spiral blade plane $n_1$ of a ½ cycle and the spiral $C_2$ running along an outer peripheral portion of the spiral blade plane, respectively, the lengths of the two segments $q_1$ and $q_2$ in the transverse direction $X_1$ of the rectangles $t_1$ and $t_2$ become half of the lengths of transverse sides of the rectangles $t_1$ and $t_2$. Additionally, as shown in FIG. 7C, since the lengths of the spirals $C_1$ and $C_2$ in one direction A are equal to each other, the lengths of the two segments $q_1$ and $q_2$ become equal to each other in the longitudinal direction $Y_1$ of the rectangles $t_1$ and $t_2$. Thereby, in a case where a conveying member having a spiral blade plane on the downstream side in a conveying direction is rotated around an axis, the lengths of the two segments $q_1$ and $q_2$ in the longitudinal direction $Y_1$ are equal to each other. Thus, the conveying speed of a developer on the side of the outer peripheral portion of the conveying member and the conveying speed of the developer on the side of the inner peripheral portion become approximately equal to each other.

Additionally, the angles formed by the two segments $q_1$ and $q_2$ and the transverse sides of the rectangles $t_1$ and $t_2$ are lead angles $\theta_1$ and $\theta_2$, respectively. When the length $L_{Y1}$ of the two segments q1 and q2 in the longitudinal direction $Y_1$ is expressed using $\theta_1$ or $\theta_2$, $L_{Y1}=\pi\cdot r_1\cdot\tan\theta_1=\pi\cdot R_1\cdot\tan\theta_2$ ($\pi$ represents the circumference ratio in the expressions) is established. Additionally, when $\theta_2$ is expressed using $\theta_1$, $\theta_2=\tan^{-1}(r_1\cdot\tan\theta_1/R_1)$ is established.

In a case where a spiral blade piece is used as the first conveying blade 112*a*, the spiral blade piece is configured so that the radius $r_1$ of the imaginary cylinder $K_1$ becomes equal to the radius r of the first rotating shaft 112*b* and the lead angle $\theta_1$ of the spiral $C_1$ becomes equal to the lead angle $\theta_X$ of the first imaginary spiral. Moreover, the spiral blade piece is provided so that the spiral blade plane becomes the downstream side in the conveying direction (the direction of the arrow X), and the spiral $C_1$ running along the inner peripheral portion of the spiral blade piece coincides with the first imaginary spiral. As long as the spiral blade piece is configured in this way, the spiral blade piece may have arbitrary shapes. For example, the attachment angle $\alpha$ may not be 90°, and can be appropriately set within a range of 30° to 150°. Additionally, the lead angle $\theta_1$ can be appropriately set within a range of, for example, 20° to 70°. Additionally, the length $m_1$ of the segment $L_1$ in the radial direction of the imaginary cylinder $K_1$, i.e., the length of the spiral blade piece in the radial direction can be appropriately set within a range of, for example, 2 mm to 20 mm.

In the present embodiment, the individual first conveying blades 112*a* are spiral blade pieces each having a spiral blade plane of a ¼ cycle, and are provided so as to be separated from each other in the axial direction of the first rotating shaft 112*b*. Since the individual first conveying blades 112*a* are provided so as to be separated from each other in this way, a gap G through which a toner passes is formed between adjacent first conveying blades 112*a*, and the toner is easily diffused in the axial direction of the first rotating shaft 112*b* through the gap G. Accordingly, even if the toner in the developer tank 111 is consumed locally or an unused toner is supplied, the toner is diffused rapidly and unevenness of toner concentration in a developer does not easily occur. Thus, unevenness of image density can be suppressed.

The interval between adjacent first conveying blades 112*a* in the axial direction can be appropriately set within a range of 0.5 mm to 10 mm. Additionally, the individual first conveying blades 112*a* may be separated from each other in the circumferential direction of the first rotating shaft 112*b*. The interval between adjacent first conveying blades 112*a* in the circumferential direction can be appropriately set within a range of 0 mm to 10 mm. The case where the interval in the circumferential direction is 0 mm includes not only a case where adjacent first conveying blades 112*a* are in contact with each other in the circumferential direction, but also a case where the adjacent first conveying blades overlap each other in the circumferential direction. In the present embodiment, all the intervals between adjacent first conveying blades 112*a* are equal, and the adjacent first conveying blades are provided so as to be separated from each other by 2 mm in the axial direction and be in contact with each other in the circumferential direction. By providing the first conveying blades 112*a* at equal intervals in this way, the load applied to a developer during conveyance of the developer can be distributed. Additionally, in a case where adjacent first conveying blades 112*a* are provided so as to be in contact with each other or overlap each other in the circumferential direction in this way, as shown in FIG. 4, the first conveying blades 112*a* constitute a ring surrounding the periphery of the first rotating shaft 112*b* when the first conveying member 112 is seen from a position separated in the axial direction from the first conveying member 112. By providing the first conveying blades 112*a* so as to constitute such a ring, the load applied to a developer during conveyance of the developer can be further distributed.

Additionally, since the first conveying member 112 includes a plurality of first conveying blades 112*a*, even if one first conveying blade 112*a* is damaged, the damaged first conveying blade 112*a* can be replaced independently and the first conveying member 112 can be easily repaired.

Figure 8:
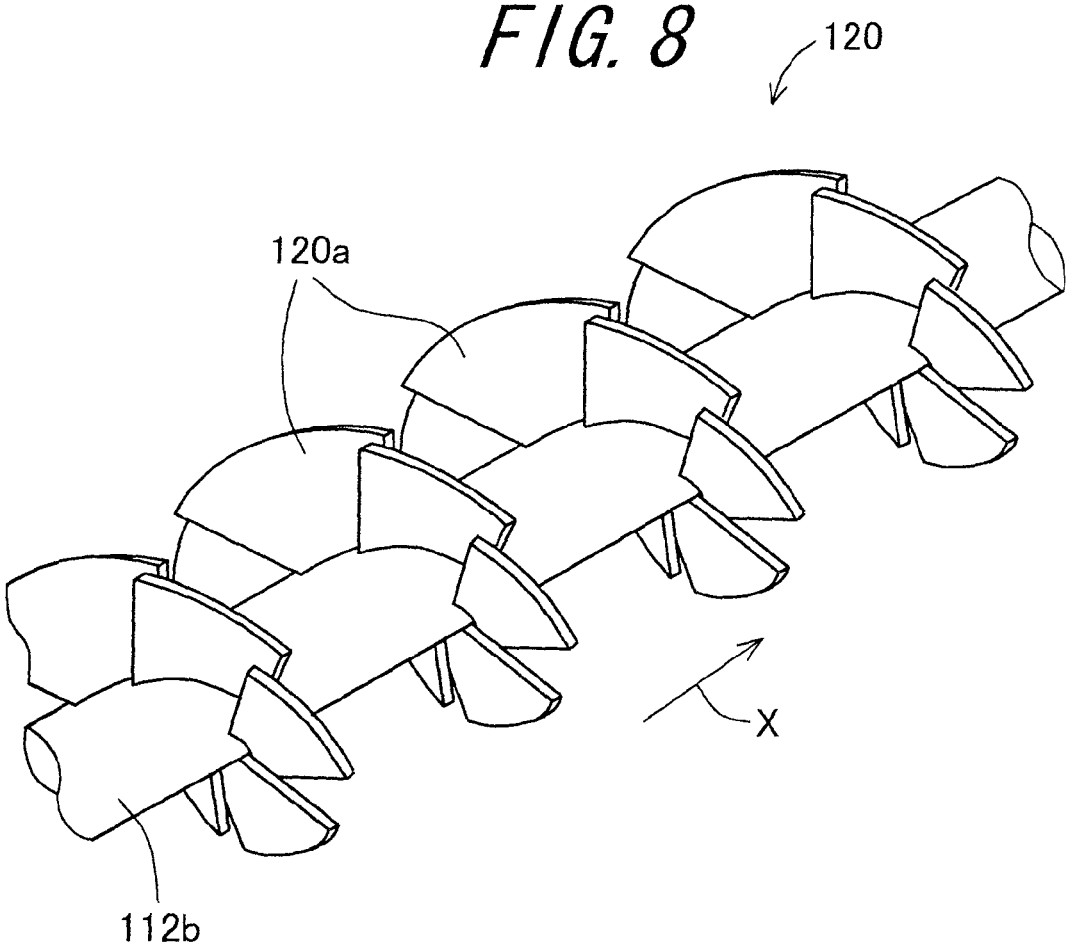
FIG. 8 is a perspective view of a first conveying member.
Figure 9:
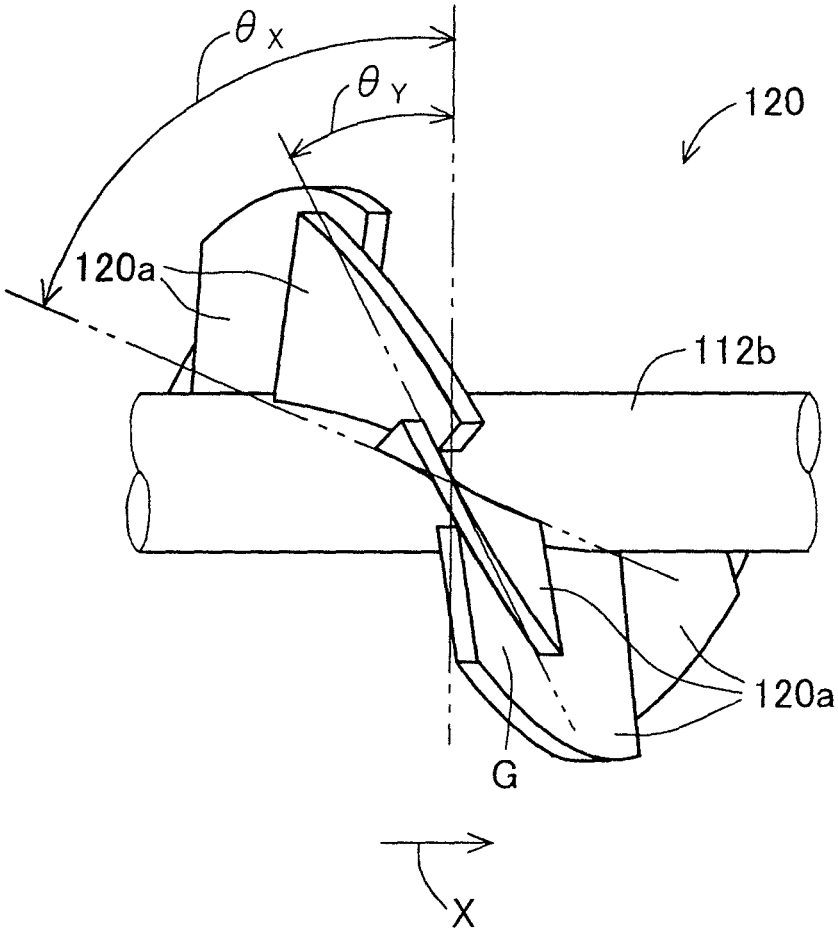
FIG. 9 is a side view of the first conveying member.
Figure 10:
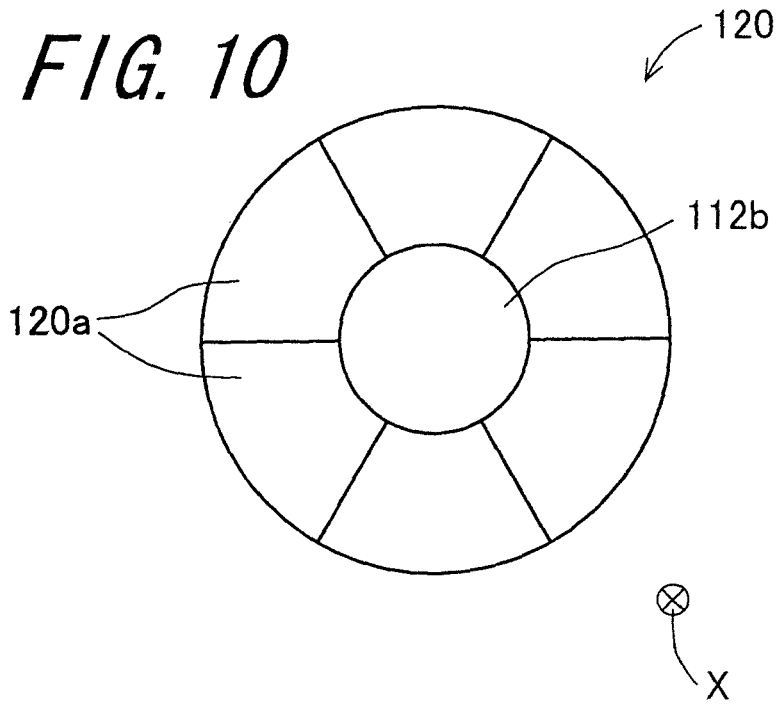
FIG. 10 is a front view of the first conveying member.

Next, a first conveying member 120 provided instead of the first conveying member 112 will be described as a second embodiment of the invention. FIG. 8 is a perspective view of the first conveying member 120. FIG. 9 is a side view of the first conveying member 120. FIG. 10 is a front view of the first conveying member 120. The first conveying member 120 includes a plurality of first conveying blades 120*a*, the first rotating shaft 112*b*, and the first conveying gear (not shown). The first conveying blades 120*a*, the first rotating shaft 112*b*, and the first conveying gear are formed of, for example, materials such as polyethylene, polypropylene, high impact polystyrene, and ABS resin.

As the first conveying blades 120*a* rotate with the rotation of the first rotating shaft 112*b*, the first conveying blades convey the developer of the first conveying passage P in the direction of the arrow X. The first conveying blades 120*a* are provided along a first imaginary spiral (not shown) which surrounds the outer periphery of the first rotating shaft 112*b* and advances in the axial direction of the first rotating shaft 112*b* at a predetermined lead angle $\theta_X$. Additionally, the first conveying blades 120*a* are provided so that the outer peripheral portions thereof run along a second imaginary spiral (not shown). The outer peripheral portions of the first conveying blades 120*a* are the portions of the first conveying blades 120*a* most separated from the first rotating shaft 112*b*. The second imaginary spiral is a spiral which surrounds an imaginary cylinder whose axis coincides with that of the first rotating shaft 112*b* and advances in the axial direction of the first rotating shaft 112*b* at a predetermined lead angle $\theta_Y$, and is a spiral which satisfies the following expression (1):

$$0[°]<\theta_Y[°]<\tan^{-1}(r\cdot\tan\theta_X/R)[°]<90[°] \quad (1)$$

in which R (>r) is the radius of an imaginary cylinder which the second imaginary spiral surrounds.

The lead angle $\theta_X$ of the first imaginary spiral can be appropriately set within a range of, for example, 20° to 70°, and the lead angle $\theta_Y$ of the second imaginary spiral can be appropriately set within a range of, for example, 0° to 60°. The first imaginary spiral may be a stretch of a spiral and may be a multi-spiral. Additionally, the second imaginary spiral may be a stretch of a spiral and may be a multi-spiral. The individual first conveying blades 120*a* are provided along a portion of less than one cycle of the first imaginary spiral. In the present embodiment, the individual first conveying blades 120*a* are formed of twisted blades having all the same shape, and are provided along the portion of a ⅙ cycle of the first imaginary spiral.

In the invention, the "twisted blades" are members roughly having a shape which twist the spiral blade pieces, and more specifically, are members each having a twisted blade plane as a main plane. In the invention, the "twisted blade plane" is a plane formed by the locus of one segment $L_2$ when the segment $L_2$ has been moved in one direction A parallel to the axis of an imaginary cylinder $K_1$ while an attachment angle β is changed so as to increase continuously at a predetermined rate with the length of the segment $L_2$ in the radial direction of the imaginary cylinder $K_1$ being maintained, along the portion of less than one cycle of one spiral $C_1$ (whose lead angle is defined as $\theta_1$) surrounding the lateral surface of the imaginary cylinder $K_1$. The "attachment angle β" is an angle formed by the segment $L_2$ and a half-line extending in one direction A from the point of contact between the segment $L_2$ and the imaginary cylinder $K_1$, in a plane including the axis of the imaginary cylinder $K_1$ and the segment $L_2$, and is an angle which is greater than 0° and smaller than 180°.

Figure 11B:
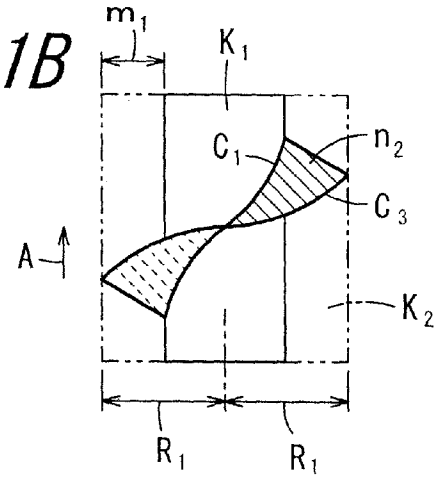
FIGS. 11A to 11C are views for explaining the twisted blade plane of a ½ cycle.
Figure 11A:
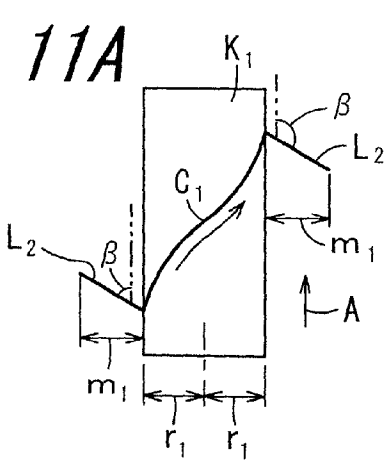
Figure 11C:
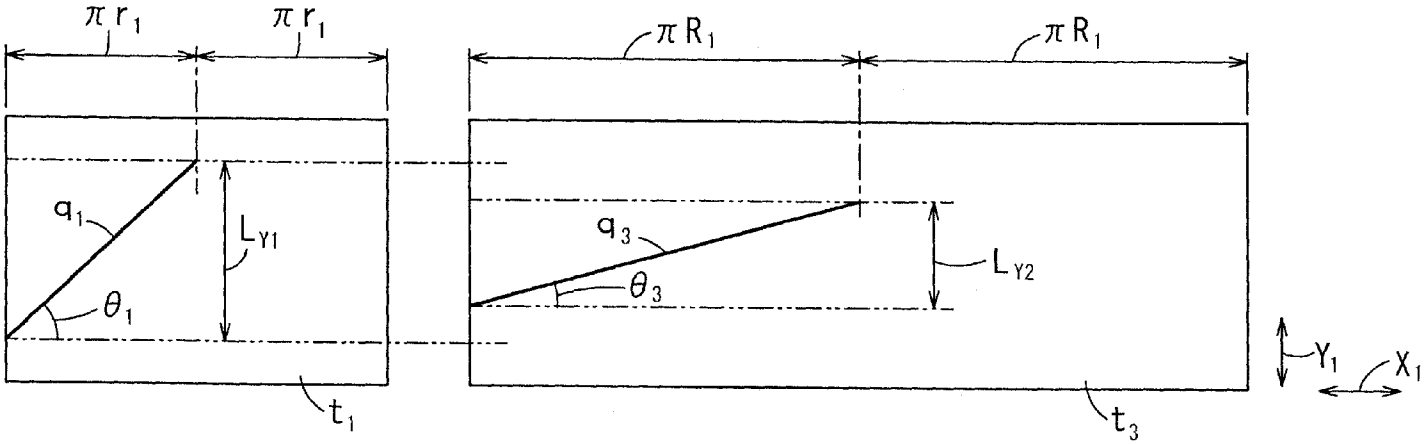

A twisted blade plane when a segment has been moved along the portion of a ½ cycle of a spiral (expressed as a "twisted blade plane of a ½ cycle"; the same is true of other cycles) is shown below as an example of the twisted blade plane. FIGS. 11A to 11C are views for explaining the twisted blade plane of a ½ cycle. FIG. 11A shows the lateral surface of an imaginary cylinder $K_1$, a spiral $C_1$ on the lateral surface of the imaginary cylinder $K_1$, and the start position and end position of a segment $L_2$ which moves on the spiral $C_1$ in one direction A. On the sheet surface of FIG. 11A, the segment $L_2$ shown on the left represents a start position during movement, and the segment $L_2$ shown on the right represents an end position. As shown in FIG. 11A, when the segment $L_2$ is moved in one direction A along the spiral $C_1$ while the attachment angle β is changed so as to increase continuously at a predetermined rate (in FIGS. 11A to 11C, β=60° at a start position and β=120° at an end position) with the length $m_1$ of the segment $L_2$ in the radial direction of the imaginary cylinder $K_1$ being maintained, the locus of the segment $L_2$ becomes a twisted blade plane $n_2$ shown in FIG. 11B. The plane shown by a hatched portion in FIG. 11B is the twisted blade plane $n_2$.

As shown in FIG. 11B, an outer peripheral portion of the twisted blade plane $n_2$ runs along a spiral $C_3$ (whose lead angle is defined as $\theta_3$) which surrounds an imaginary cylinder $K_2$ whose axis coincides with that of the imaginary cylinder $K_1$. The radius $R_1$ of the imaginary cylinder $K_2$ is equal to the sum of the radius $r_1$ of the imaginary cylinder $K_1$, and the length $m_1$ of the segment $L_2$ in the radial direction of the imaginary cylinder $K_1$. A rectangle $t_1$ when the lateral surface of the imaginary cylinder $K_1$ is developed and a rectangle $t_3$ when the lateral surface of the imaginary cylinder $K_2$ is developed are shown in FIG. 11C. As shown in FIG. 11C, the lines corresponding to the spirals $C_1$ and $C_3$ in the rectangles $t_1$ and $t_3$ become segments $q_1$ and $q_3$ extending obliquely in the rectangles $t_1$ and $t_3$. Since these two segments $q_1$ and $q_3$ correspond to the spiral $C_1$ running along an inner peripheral portion of the twisted blade plane $n_2$ of a ½ cycle and the spiral $C_3$ running along an outer peripheral portion of the twisted blade plane, respectively, the lengths of the two segments $q_1$ and $q_3$ in the transverse direction $X_1$ of the rectangles $t_1$ and $t_3$ become half of the lengths of transverse sides of the rectangles $t_1$ and $t_3$. Additionally, as shown in FIG. 11C, since the attachment angle β increases at the end position, the length of the spiral $C_1$ in one direction A becomes larger than the length of the spiral $C_3$ in the one direction A. Thus, in the longitudinal direction $Y_1$ of the rectangles $t_1$ and $t_3$, the segment $q_1$ corresponding to the spiral $C_1$ becomes longer than the segment $q_3$ corresponding to the spiral $C_3$. Thereby, in a case where a conveying member having a twisted blade plane on the downstream side in a conveying direction is rotated around an axis, the segment $q_3$ corresponding to the spiral $C_3$ in the longitudinal direction $Y_1$ is shorter. Thus, the conveying speed of a developer on the side of the outer peripheral portion of the conveying member becomes slower than the conveying speed of the developer on the side of the inner peripheral portion.

Additionally, the angles formed by the two segments $q_1$ and $q_3$ and the transverse sides of the rectangles $t_1$ and $t_3$ are lead angles $\theta_1$ and $\theta_3$, respectively. When the length $L_{Y1}$ of the segment $q_1$ in the longitudinal direction $Y_1$ is expressed using $\theta_1$, $L_{Y1}=\pi\cdot r_1\cdot\tan\theta_1$ (π represents the circumference ratio in the expression) is established. Additionally, when the length $L_{Y2}$ of the segment $q_3$ in the longitudinal direction $Y_1$ is expressed using $\theta_3$, $L_{Y2}=\pi\cdot R_1\cdot\tan\theta_3$ (π represents the circumference ratio in the expression) is established. Since $L_{Y1}>L_{Y2}$ is satisfied as described above, $\theta_3<\tan^{-1}(r_1\cdot\tan\theta_1/R_1)$ is established. It can be seen from the above that, since the conveying member having a twisted blade plane on the downstream side in the conveying direction satisfies $\theta_3<\tan^{-1}(r_1\cdot\tan\theta_1/R_1)$, the conveying speed of a developer on the side of the outer peripheral portion of the conveying member becomes slower than the conveying speed of the developer on the side of the inner peripheral portion.

In a case where a twisted blade is used as the first conveying blade 120*a*, the twisted blade is configured so that the radius $r_1$ of the imaginary cylinder $K_1$ becomes equal to the radius r of the first rotating shaft 112*b* and the lead angle $\theta_1$ of the spiral $C_1$ becomes equal to the lead angle $\theta_X$ of the first imaginary spiral. Additionally, the twisted blade is provided so that the twisted blade plane becomes the downstream side in the conveying direction (the direction of the arrow X), and the spiral $C_1$ running along the inner peripheral portion of the twisted blade coincides with the first imaginary spiral. Moreover, the twisted blade is configured so that the lead angle $\theta_3$ of the spiral $C_3$ running along the outer peripheral portion of the twisted blade is equal to the lead angle $\theta_Y$ of the second imaginary spiral and the spiral $C_3$ coincides with the second imaginary spiral.

As such, in the present embodiment, a twisted blade is provided as the first conveying blade 120*a* so as to satisfy $\theta_Y < \tan^{-1}(r \cdot \tan \theta_X / R)$. Thereby, the conveying speed of a developer becomes faster on the side of the inner peripheral portion of the first conveying member 120, and becomes slower on the side of the outer peripheral portion. Accordingly, since the aggregation caused by friction or pressure is kept from occurring in the toner on the side of the outer peripheral portion, i.e., the toner in the gap between the first conveying member 120 and the internal wall of the developer tank 111, image fogging can be suppressed.

As long as the twisted blade is configured as described above, the twisted blade may have arbitrary shapes. The attachment angle β at the start position does not need to be 60°, and can be appropriately set within a range of, for example, 20° to 150°. The attachment angle β at the end position does not need to be 120°, and can be appropriately set within a range of, for example, 40° to 170°. Additionally, the lead angle $\theta_1$ can be appropriately set within a range of, for example, 20° to 70°, and the lead angle $\theta_3$ can be appropriately set within a range of, for example, 0° to 60°. Additionally, the length $m_1$ of the segment $L_2$ in the radial direction of the imaginary cylinder $K_1$, i.e., the length $m_1$ of the twisted blade in the radial direction can be appropriately set within a range of, for example, 2 mm to 20 mm.

In the present embodiment, the individual first conveying blades 120*a* are twisted blades each having a twisted blade plane of a ⅙ cycle, and are provided so as to be separated from each other in the axial direction of the first rotating shaft 112*b*. Since the individual first conveying blades 120*a* are provided so as to be separated from each other in this way, a gap G through which a toner passes is formed between adjacent first conveying blades 120*a*, and the toner is easily diffused in the axial direction of the first rotating shaft 112*b* through the gap G. Accordingly, even if the toner in the developer tank 111 is consumed locally or an unused toner is supplied, the toner is diffused rapidly and unevenness of toner concentration in a developer does not easily occur. Thus, unevenness of image density can be suppressed.

The interval between adjacent first conveying blades 120*a* in the axial direction can be appropriately set within a range of 0.5 mm to 10 mm. Additionally, the individual first conveying blades 120*a* may be separated from each other in the circumferential direction of the first rotating shaft 112*b*. The interval between adjacent first conveying blades 120*a* in the circumferential direction can be appropriately set within a range of 0 mm to 10 mm. The case where the interval in the circumferential direction is 0 mm includes not only a case where adjacent first conveying blades 120*a* are contact with each other in the circumferential direction, but also a case where the adjacent first conveying blades overlap each other in the circumferential direction. In the present embodiment, all the intervals between adjacent first conveying blades 120*a* are equal, and the adjacent first conveying blades are provided so as to be separated from each other by 2 mm in the axial direction and be in contact with each other in the circumferential direction. By providing the first conveying blades 120*a* at equal intervals in this way, the load applied to a developer during conveyance of the developer can be distributed. Additionally, in a case where adjacent first conveying blades 120*a* are provided so as to be in contact with each other or overlap each other in the circumferential direction in this way, as shown in FIG. 10, the first conveying blades 120*a* constitute a ring surrounding the periphery of the first rotating shaft 112*b* when the first conveying member 120 is seen from a position separated in the axial direction from the first conveying member 120. By providing the first conveying blades 120*a* so as to constitute such a ring, the load applied to a developer during conveyance of the developer can be further distributed.

Additionally, since the first conveying member 120 includes a plurality of first conveying blades 120*a*, even if one first conveying blade 120*a* is damaged, the damaged first conveying blade 120*a* can be replaced independently and the first conveying member 120 can be easily repaired.

Additionally, since the first conveying blades 120*a* related to the present embodiment are formed of twisted blades, the surfaces thereof in contact with a developer are smooth and have no level difference. Accordingly, the conveying speed of a developer becomes continuously slower from the inner peripheral portion of the first conveying blade 120*a* to the outer peripheral portion thereof. Accordingly, since a discontinuous conveying speed difference is not caused between developers, the friction between developers can be suppressed. Additionally, since the surfaces in contact with a developer are smooth, stagnation of the developer can also be suppressed.

Figure 12:
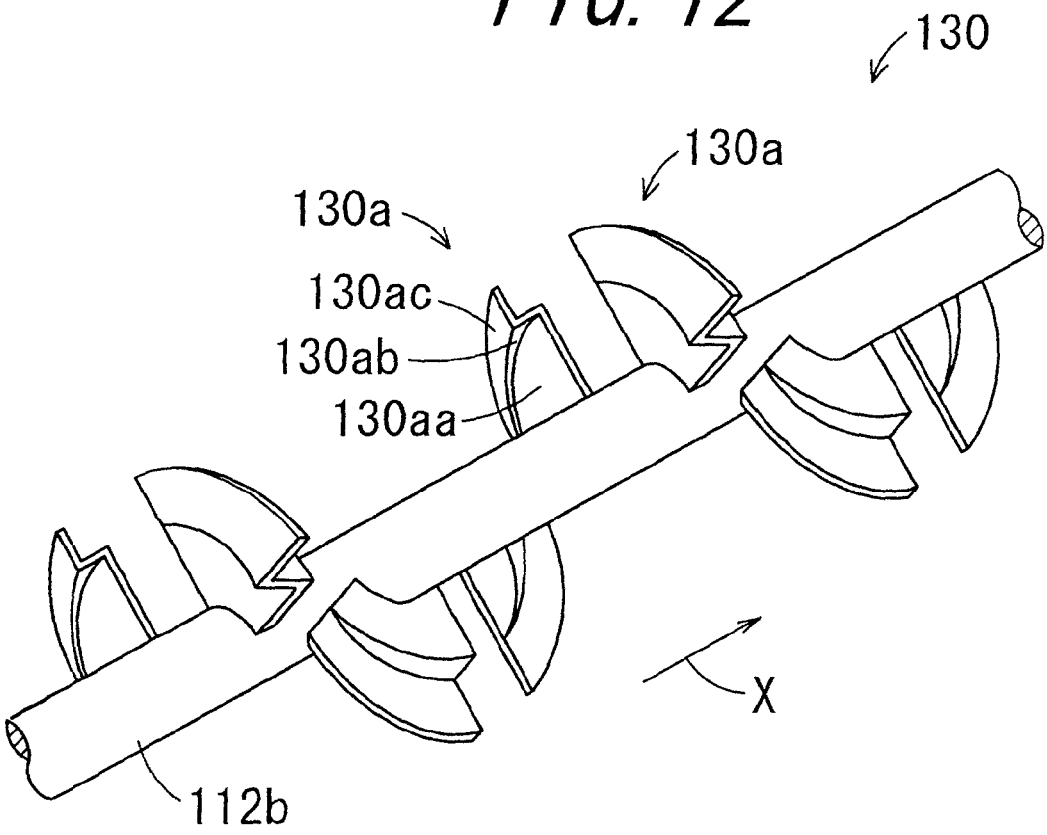
FIG. 12 is a perspective view of a first conveying member.
Figure 13:
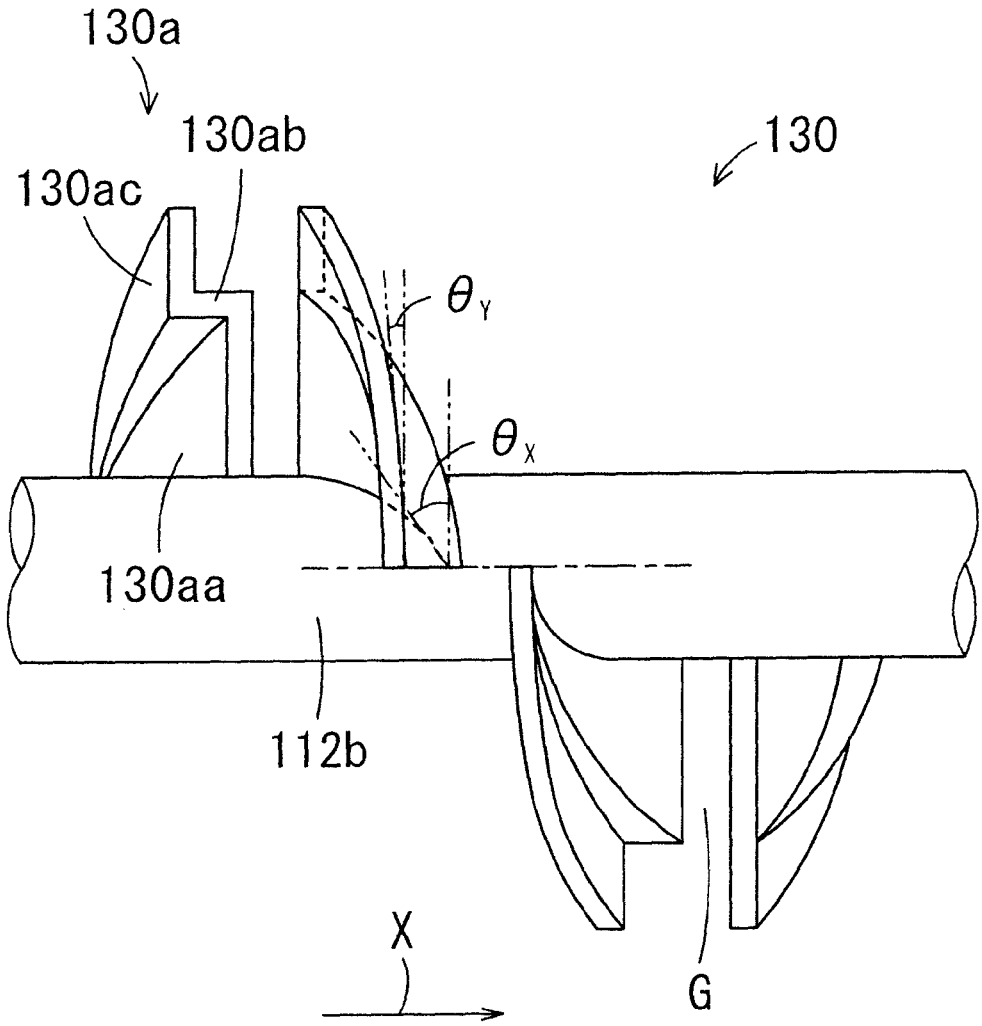
FIG. 13 is a side view of the first conveying member.
Figure 14:
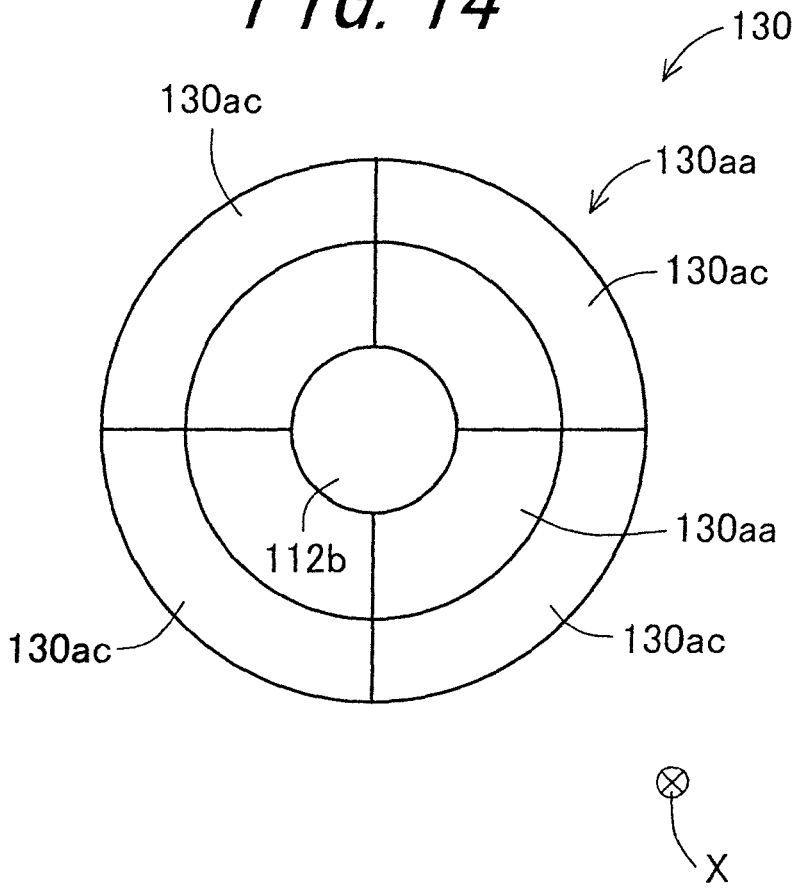
FIG. 14 is a front view of the first conveying member.

Next, a first conveying member 130 provided instead of the first conveying member 112 will be described as a third embodiment of the invention. FIG. 12 is a perspective view of the first conveying member 130. FIG. 13 is a side view of the first conveying member 130. FIG. 14 is a front view of the first conveying member 130. The first conveying member 130 includes a plurality of first conveying blades 130*a*, the first rotating shaft 112*b*, and the first conveying gear (not shown). The first conveying blades 130*a*, the first rotating shaft 112*b*, and the first conveying gear are formed of, for example, materials such as polyethylene, polypropylene, high impact polystyrene, and ABS resin.

The first conveying blades 130*a* rotate with the rotation of the first rotating shaft 112*b*, thereby conveying the developer of the first conveying passage P in the direction of the arrow X. The first conveying blades 130*a* are provided along a first imaginary spiral (not shown) which surrounds the outer periphery of the first rotating shaft 112*b* and advances in the axial direction of the first rotating shaft 112*b* at a predetermined lead angle $\theta_X$. Additionally, the first conveying blades 130*a* are provided so that the outer peripheral portions thereof run along a second imaginary spiral (not shown). The outer peripheral portions of the first conveying blades 130*a* are the portions of the first conveying blades 130*a* most separated from the first rotating shaft 112*b*. The second imaginary spiral is a spiral which surrounds an imaginary cylinder whose axis coincides with that of the first rotating shaft 112*b* and advances in the axial direction of the first rotating shaft 112*b* at a predetermined lead angle $\theta_Y$, and is a spiral which satisfies the following expression (1):

$$0[°]<\theta_Y[°]<\tan^{-1}(r\cdot\tan\theta_X/R)[°]<90[°] \quad (1)$$

in which R (>r) is the radius of an imaginary cylinder which the second imaginary spiral surrounds.

The lead angle $\theta_X$ of the first imaginary spiral can be appropriately set within a range of, for example, 20° to 70°, and the lead angle $\theta_Y$ of the second imaginary spiral can be appropriately set within a range of, for example, 0° to 60°. The first imaginary spiral may be a stretch of a spiral and may be a multi-spiral. Additionally, the second imaginary spiral may be a stretch of a spiral and may be a multi-spiral. The individual first conveying blades 130*a* are provided along a portion of less than one cycle of the first imaginary spiral. In the present embodiment, the individual first conveying blades 130*a* are provided along the portion of a ¼ cycle of the first imaginary spiral.

In the present embodiment, the individual first conveying blades 130*a* have all the same shape, and are formed of multi-stage spiral blade pieces (two-stage spiral blade pieces) each including a lower-stage spiral blade piece 130*aa*, a connecting portion 130*ab*, and an upper-stage spiral blade piece 130*ac*. In the invention, the "multi-stage spiral blade pieces" are members including the structure in which an outer peripheral portion of one spiral blade piece is connected to an inner peripheral portion of the other spiral blade piece, and are members which are provided so that the lead angle of a spiral running along the inner peripheral portion of the other spiral blade piece becomes smaller than the lead angle of a spiral running along the outer peripheral portion of the one spiral blade piece. Although the first conveying blade 130*a* related to the present embodiment may have the structure in which two spiral blade pieces of the lower-stage spiral blade piece 130*aa* and the upper-stage spiral blade piece 130*ac* are connected via the connecting portion 130*ab*, the first conveying blades may have the structure in which three or more spiral blade pieces are connected. The connecting portion 130*ab* is provided in order to improve the strength of the first conveying blade 130*a*. In the present embodiment, the connecting portion 130*ab* is provided perpendicularly to both the lower-stage spiral blade piece 130*aa* and the upper-stage spiral blade piece 130*ac*. However, the invention is not limited thereto. Additionally, the connecting portion 130*ab* may be provided with a hole and a cutout for improvement in diffusivity of a toner.

In a case where a multi-stage spiral blade piece is used as the first conveying blade 130*a*, an inner peripheral portion of a spiral blade piece on the innermost peripheral side of the multi-stage spiral blade piece, and the first rotating shaft 112*b* are connected together. Additionally, the multi-stage spiral blade piece is configured so that the radius of an imaginary cylinder surrounding a spiral running along the inner peripheral portion of the spiral blade piece on the innermost peripheral side becomes equal to the radius r of the first rotating shaft 112*b* and the lead angle of the spiral becomes equal to the lead angle $\theta_X$ of the first imaginary spiral. Additionally, the multi-stage spiral blade piece is provided so that each spiral blade plane becomes the downstream side in the conveying direction (the direction of the arrow X), and the spiral running along the inner peripheral portion of the spiral blade piece on the innermost peripheral side coincides with the first imaginary spiral. Moreover, the multi-stage spiral blade piece is provided so that the lead angle of the spiral running along the outer peripheral portion of the spiral blade piece on the outermost peripheral side is equal to the lead angle $\theta_Y$ of the second imaginary spiral and the spiral coincides with the second imaginary spiral.

As long as the multi-stage spiral blade piece is configured in this way, the multi-stage spiral blade piece may have arbitrary shapes. For example, the attachment angle of a spiral blade piece included in a multi-stage spiral blade piece can be appropriately set within a range of 20° to 150°. Additionally, the spiral running along the inner peripheral portion of the spiral blade piece on the innermost peripheral side included in the multi-stage spiral blade piece can be appropriately set within a range of, for example, 20° to 70°, the spiral running along the outer peripheral portion of the spiral blade piece on the outermost peripheral side can be appropriately set within a range of, for example, 0° to 60°, and the length of the multi-stage spiral blade piece in the radial direction of the first rotating shaft 112*b* can be appropriately set within a range of, for example, 2 mm to 20 mm.

For example, In a two-stage spiral blade piece like the first conveying blade 130*a*, $\theta_X>\theta_b>\theta_c>\theta_Y$ is established when the lead angle of an inner peripheral portion of a spiral blade piece on the inner peripheral side is defined as $\theta_X$, the lead angle of an outer peripheral portion of the spiral blade piece on the inner peripheral side is defined as $\theta_b$, the lead angle of an inner peripheral portion of a spiral blade piece on the outer peripheral side is defined as $\theta_c$, and the lead angle of an outer peripheral portion of the spiral blade piece on the outer peripheral side is defined as $\theta_Y$. Additionally, $\theta_b=\tan^{-1}(r\cdot\tan\theta_X/r_b)$ is established as described in the first embodiment when the radius of an imaginary cylinder surrounded by the first imaginary spiral is defined as r and the radius of an imaginary cylinder surrounded by a spiral running along the outer peripheral portion of the spiral blade piece on the inner peripheral side is defined as $r_b$. Additionally, $\theta_c=\tan^{-1}(R\cdot\tan\theta_Y/r_b)$ is established when the radius of an imaginary cylinder surrounded by the second imaginary spiral is defined as R. Accordingly, $\tan^{-1}(r\cdot\tan\theta_X/r_b)>\tan^{-1}(R\cdot\tan\theta_Y/r_b)$ is obtained from $\theta_b>\theta_c$. From this, $r\cdot\tan\theta_X/r_b>R\cdot\tan\theta_Y/r_b$ is established, and $\theta_Y<\tan^{-1}(r\cdot\tan\theta_X/R)$ is established. This expression is established even in a multi-stage spiral blade piece of three stages or more.

As such, in the present embodiment, a multi-stage spiral blade piece is provided as the first conveying blade 130*a* so as to satisfy $\theta_Y<\tan^{-1}(r\cdot\tan\theta_X/R)$. Thereby, the conveying speed of a developer becomes faster on the side of the inner peripheral portion of the first conveying member 130, and becomes slower on the side of the outer peripheral portion. Accordingly, since the aggregation caused by friction or pressure is kept from occurring in the toner on the side of the outer peripheral portion, i.e., the toner in the gap between the first conveying member 130 and the internal wall of the developer tank 111, image fogging can be suppressed.

In the present embodiment, the individual first conveying blades 130*a* have the structure in which a lower-stage spiral blade piece 130*aa* having a spiral blade piece of a ¼ cycle, and an upper-stage spiral blade piece 130*ac* having a spiral blade piece of a ¼ cycle are connected together. Additionally, the individual first conveying blades 130*a* are provided so as to be separated from each other in the axial direction of the first rotating shaft 112*b*. Since the individual first conveying blades 130*a* are provided so as to be separated from each other in this way, a gap G through which a toner passes is formed between adjacent first conveying blades 130*a*, and the toner is easily diffused in the axial direction of the first rotating shaft 112*b* through the gap G. Accordingly, even if the toner in the developer tank 111 is consumed locally or an unused toner is supplied, the toner is diffused rapidly and unevenness of toner concentration in a developer does not easily occur. Thus, unevenness of image density can be suppressed.

The interval between adjacent first conveying blades 130*a* in the axial direction can be appropriately set within a range of 0.5 mm to 10 mm. Additionally, the individual first conveying blades 130*a* may be separated from each other in the circumferential direction of the first rotating shaft 112*b*. The interval between adjacent first conveying blades 130*a* in the circumferential direction can be appropriately set within a range of 0 mm to 10 mm. The case where the interval in the circumferential direction is 0 mm includes not only a case where adjacent first conveying blades 130*a* are contact with each other in the circumferential direction, but also a case where the adjacent first conveying blades overlap each other in the circumferential direction. In the present embodiment, all the intervals between adjacent first conveying blades 130*a* are equal, and the adjacent first conveying blades are provided so as to be separated from each other by 2 mm in the axial direction and be in contact with each other in the circumferential direction. By providing the first conveying blades 130*a* at equal intervals in this way, the load applied to a developer during conveyance of the developer can be distributed. Additionally, in a case where adjacent first conveying blades 130*a* are provided so as to be in contact with each other or overlap each other in the circumferential direction in this way, as shown in FIG. 14, the first conveying blades 130*a* constitute a ring surrounding the periphery of the first rotating shaft 112*b* when the first conveying member 130 is seen from a position separated in the axial direction from the first conveying member 130. By providing the first conveying blades 130*a* so as to constitute such a ring, the load applied to a developer during conveyance of the developer can be further distributed.

Additionally, since the first conveying member 130 includes a plurality of first conveying blades 130*a*, even if one first conveying blade 130*a* is damaged, the damaged first conveying blade 130*a* can be replaced independently and the first conveying member 130 can be easily repaired. Additionally, since the first conveying blades 130*a* related to the present embodiment are formed of a plurality of spiral blade pieces, the first conveying blades can be easily repaired by replacing a spiral blade piece.

Additionally, as in the first to third embodiments, it is preferable that the first conveying blades 112*a* are respectively provided along the portion of a 1/12 cycle or more and a 1/4 cycle or less of the first imaginary spiral. By adopting such a configuration, the conveyance property of a developer and the diffusivity of the toner can be made compatible with each other.

Additionally, in the above second and third embodiments, it is preferable that the individual first conveying members 120 and 130 are configured so that the lead angle $\theta_Y$ of the second imaginary spiral satisfies the following expression (2):

$$0[°]<\tan^{-1}(0.3\cdot r\cdot\tan\theta_X/R)[°]<\theta_Y[°]<\tan^{-1}(0.7\cdot r\cdot\tan\theta_X/R)/2[°]<90[°] \quad (2).$$

For example, $7.32°<\theta_Y<16.7°$ is established when the radius r of the first rotating shaft 112*b* is set to 3 mm, the radius R of the imaginary cylinder surrounded by the second imaginary spiral is set to 10 mm, and the lead angle $\theta_X$ of the first imaginary spiral is set to 55°. Hence, for example, the individual first conveying members 120 and 130 are configured so that the lead angle $\theta_Y$ of the second imaginary spiral becomes 15°. By adopting such a configuration, the speed ratio between the conveying speed of a developer at the outer peripheral portion of the individual first conveying members 120 and 130 and the conveying speed of the developer at the inner peripheral portion can be set to a favorable speed ratio, and friction against the toner can be further suppressed.

As a method of manufacturing the individual first conveying members 112, 120 and 130, it is preferable that the individual first conveying members 112, 120 and 130 are manufactured by preparing fragments of a shape obtained by cutting the individual first conveying members 112, 120 and 130 at predetermined intervals in the axial direction in advance for improvement in strength of the individual first conveying blades 112*a*, 120*a* and 130*a*, and fixing the fragments through a metal rod sequentially. When the first conveying member is manufactured in this way, a hole through which the metal rod is inserted is formed at the center of the portion of each fragment corresponding to the first rotating shaft 112*b*. By connecting a plurality of fragments in this way to manufacture the individual first conveying members 112, 120 and 130, the design of the individual fragments becomes easy. Thus, individual fragments having sufficient strength can be formed, and the individual first conveying members 112, 120 and 130 having sufficient strength can be manufactured. In addition, in order to secure the strength of the individual first conveying blades 112*a*, 120*a* and 130*a*, it is preferable that the individual fragments have the shape including the individual first conveying blades 112*a*, 120*a* and 130*a* as they are. That is, it is preferable that the individual fragments have the shape obtained by cutting the individual first conveying members 112, 120 and 130 at predetermined intervals in the axial direction so that the individual first conveying blades 112*a*, 120*a* and 130*a* are not cut.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device comprising:

a developer tank for storing a developer;

a conveying member for conveying the developer, the conveying member including a rotating shaft and a plurality of conveying blades for conveying the developer in an axial direction of the rotating shaft which are provided along a first imaginary spiral surrounding an outer periphery of the rotating shaft and advancing in the axial direction at a predetermined lead angle; and a developing roller for bearing the developer thereon, the individual conveying blades being provided along a portion of less than one cycle of the first imaginary spiral so as to be separated from each other in the axial direction.

2. The developing device of claim 1, wherein intervals between conveying blades adjacent to each other in the axial direction in the conveying blades are all equal.

3. The developing device of claim 1, wherein the conveying blades are provided so as to run along a second imaginary spiral which satisfies the following expression (1) when an outer peripheral portion which is a portion most separated from the rotating shaft in each of the conveying blade is a second imaginary spiral surrounding an imaginary cylinder in which the rotating shaft and the axis coincide with each other and advancing in the axial direction at a predetermined lead angle:

$$0[°]<\theta_Y[°]<\tan^{-1}(r\cdot\tan\theta_X/R)[°]<90[°] \quad (1)$$

in which $\theta_X$ is a lead angle of the first imaginary spiral, $\theta_Y$ is a lead angle of the second imaginary spiral, r is a radius of the rotating shaft, and R (>r) is a radius of the imaginary cylinder.

4. The developing device of claim 3, wherein the conveying blades are multi-stage spiral blade pieces.

5. The developing device of claim 3, wherein the conveying blades are twisted blades.

6. The developing device of claim 3, wherein the conveying member is configured so that the lead angle $\theta_Y$ of the second imaginary spiral satisfies the following expression (2):

$$0[°]<\tan^{-1}(0.3\cdot r\cdot\tan\theta_X/R)[°]<\theta_Y[°]<\tan^{-1}(0.7\cdot r\cdot\tan\theta_X/R)/2[°]<90[°] \quad (2).$$

7. The developing device of claim 1, wherein the conveying blades are respectively provided along the portion of a 1/12 cycle or more and a 1/4 cycle or less of the first imaginary spiral.

8. An electrophotographic image forming apparatus comprising the developing device of claim 1.

* * * * *